US011608653B2

(12) United States Patent
Chou et al.

(10) Patent No.: US 11,608,653 B2
(45) Date of Patent: Mar. 21, 2023

(54) ENERGY DISSIPATION DEVICE

(71) Applicant: NATIONAL APPLIED RESEARCH LABORATORIES, Taipei (TW)

(72) Inventors: Chung-Che Chou, Taipei (TW); Li-Yu Huang, Taichung (TW); Ping-Ting Chung, Tainan (TW)

(73) Assignee: NATIONAL APPLIED RESEARCH LABORATORIES, Taipei (TW)

( * ) Notice: Subject to any disclaimer, the term of this patent is extended or adjusted under 35 U.S.C. 154(b) by 9 days.

(21) Appl. No.: 17/453,282

(22) Filed: Nov. 2, 2021

(65) Prior Publication Data

US 2023/0038362 A1 Feb. 9, 2023

(30) Foreign Application Priority Data

Aug. 6, 2021 (TW) ..... 110129052

(51) Int. Cl.
*E04H 9/02* (2006.01)

(52) U.S. Cl.
CPC ..... *E04H 9/021* (2013.01); *E04H 9/02* (2013.01); *E04H 9/024* (2013.01); *E04H 9/0235* (2020.05); *E04H 9/0237* (2020.05)

(58) Field of Classification Search
CPC ..... E04H 9/021; E04H 9/0235; E04H 9/0237; E04H 9/02; E04H 9/024
See application file for complete search history.

(56) References Cited

U.S. PATENT DOCUMENTS 8,763,320 B1 * 7/2014 Chou ..... E04H 12/16 52/167.3
2012/0000147 A1 * 1/2012 Chou ..... E04H 9/0237 52/167.1
2014/0360108 A1 * 12/2014 Fujiu ..... E04H 9/0235 52/167.7
2017/0030701 A1 * 2/2017 Saxey ..... E04H 9/024
2018/0283487 A1 * 10/2018 Hattori ..... G02B 23/16

FOREIGN PATENT DOCUMENTS

TW I454608 B 10/2014
WO WO-2017054323 A1 * 4/2017 ..... E04B 1/98
WO WO-2019019849 A1 * 1/2019 ..... E04B 1/98

* cited by examiner

*Primary Examiner* — Phi D A
(74) *Attorney, Agent, or Firm* — Wombile Bond Dickinson (US) LLP

(57) ABSTRACT

An energy dissipation device includes a primary core module, a housing module, first and second outer plates, an energy dissipation unit, first and second preload tension members and a resilient compression unit. When the primary core module and the housing module are subjected to an external force, the first and second preload tension members stretched by the external force, and the resilient compression unit is compressed, such that relative movement between the primary core module and the housing module is generated. The energy dissipation unit generates a retarding force during the relative movement between the primary core module and the housing module, so as to dissipate the kinetic energy generated as a result of the external force.

11 Claims, 17 Drawing Sheets

ENERGY DISSIPATION DEVICE

CROSS-REFERENCE TO RELATED APPLICATION

This application claims priority to Taiwanese Invention Patent Application No. 110129052, filed on Aug. 6, 2021.

FIELD

The disclosure relates to an energy dissipation device, and more particularly to a two-core energy dissipation device.

BACKGROUND

A building may be provided with an energy dissipation device to dissipate kinetic energy generated during earthquakes. However, a conventional energy dissipation device may not be able to dissipate the kinetic energy sufficiently, so a powerful earthquake may cause plastic deformation or residual stress in the building, which renders the building unsafe.

SUMMARY

Therefore, an object of the disclosure is to provide an energy dissipation device that can alleviate at least one of the drawbacks of the prior art.

According to the disclosure, the energy dissipation device is adapted to be installed in a building, and includes a primary core module, a secondary core module, a housing module, a first inner plate, a second inner plate, a first outer plate, a second outer plate, an energy dissipation unit, a first preload tension member, a second preload tension member and a resilient compression unit. The primary core module includes a main body, and a primary extension section that is mounted to the main body and that is adapted to be connected to the building. The secondary core module is disposed parallel to the primary core module. The housing module includes an outer tubular body that surrounds the primary core module and the secondary core module, and a housing extension section that is mounted to the outer tubular body and that is adapted to be connected to the building. The first inner plate and the second inner plate are respectively disposed at two opposite sides of the secondary core module. The secondary core module has opposite first and second push portions that are respectively in contact with the first inner plate and the second inner plate. The outer tubular body of the housing module has opposite first and second push portions that are respectively in direct or indirect contact with the first outer plate and the second outer plate. The main body of the primary core module has opposite first and second push portions that are respectively in direct or indirect contact with the first inner plate and the second inner plate or with the first outer plate and the second outer plate. The energy dissipation unit dissipates kinetic energy generated by a relative movement between the primary core module and the housing module, a relative movement between the housing module and the first outer plate or a relative movement between the housing module and the second outer plate. The first preload tension member extends in the extending direction of the outer tubular body of the housing module, and extends through the outer tubular body. The first preload tension member having an end portion that is connected to the first inner plate, and an opposite end portion that is connected to the one of the second inner plate and the second outer plate which is in contact with the second push portion of the main body of the primary core module. The second preload tension member extends in the extending direction of the outer tubular body of the housing module, and extends through the outer tubular body. The second preload tension member has an end portion that is connected to the first outer plate, and an opposite end portion that is connected to the other one of the second inner plate and the second outer plate which is not in contact with the second push portion of the main body of the primary core module. The resilient compression unit is disposed on at least one of the secondary core module, the first preload tension member and the second preload tension member. When the primary extension section of the primary core module and the housing extension section of the housing module are subjected to an external force, the first preload tension member and the second preload tension member are stretched by the external force, and the resilient compression unit is compressed, such that relative movement between the primary core module and the housing module and relative movement between the housing module and the first outer plate or between the housing module and the second outer plate are generated. The energy dissipation unit generates a retarding force during the relative movement between the primary core module and the housing module or during the relative movement between the housing module and the first outer plate or between the housing module and the second outer plate, so as to dissipate the kinetic energy generated as a result of the external force.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
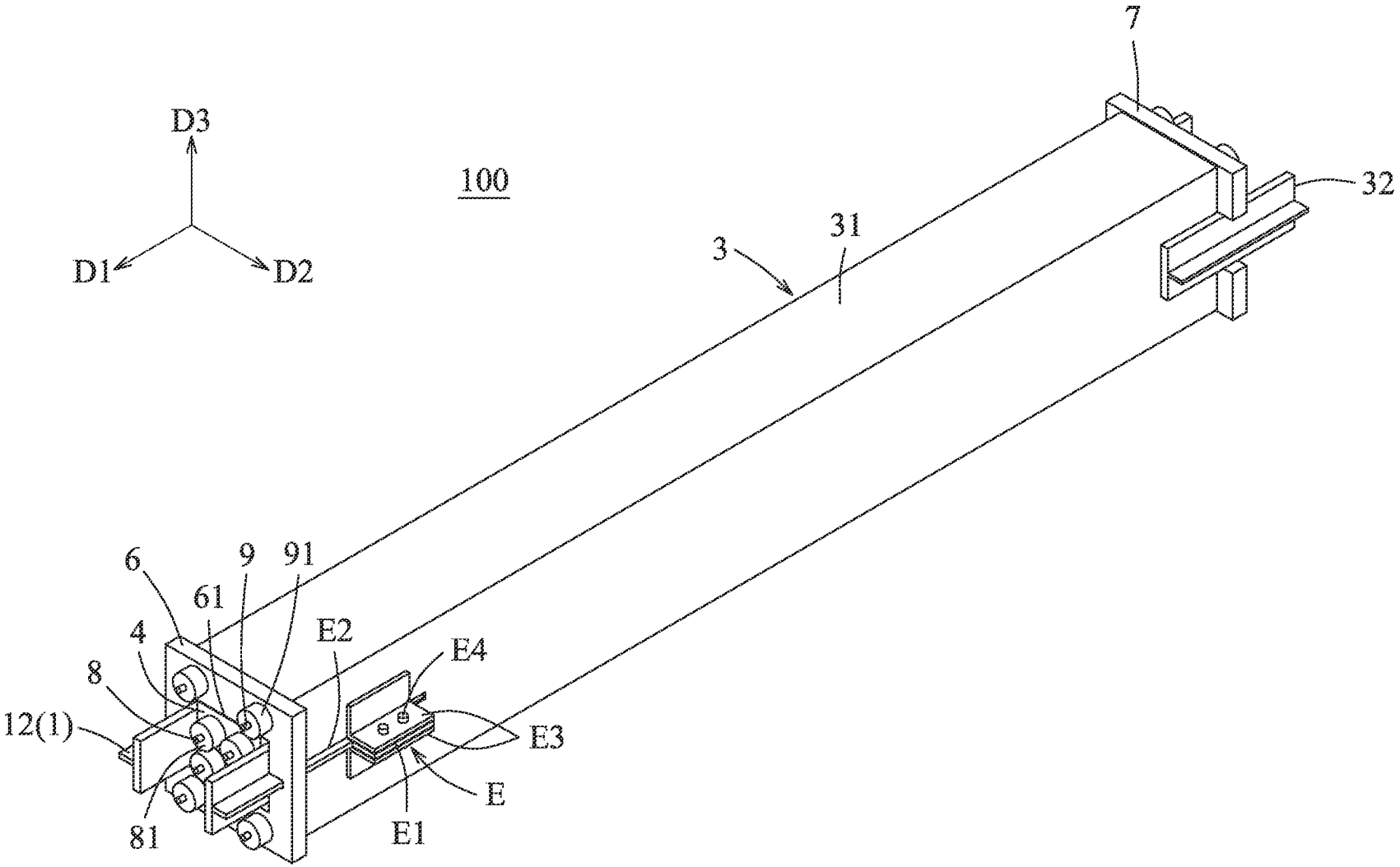
FIG. 1 is a perspective view illustrating a first embodiment of the energy dissipation device according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIGS. 1 to 5, a first embodiment of the energy dissipation device 100 according to the disclosure is adapted to be installed in a building (not shown). The energy dissipation device 100 includes a primary core module 1, two secondary core modules 2, a housing module 3, a first inner plate 4, a second inner plate 5, a first outer plate 6, a second outer plate 7, four first preload tension members 8, four second preload tension members 9, an energy dissipation unit (E) and a resilient compression unit (S). It should be noted that the number of each of the components is not limited to the above. In one embodiment, the number of each of the components may be at least one, and can be adjusted according to practical requirements. In one embodiment, the primary core module 1, the secondary core modules 2 and the housing module 3 may be made of steel. Each of the first preload tension members 8 and the second preload tension members 9 may be configured as fiberglass, carbon fiber, a steel wire rope, a steel rod or a metal alloy rod that is able to be stretched.

The primary core module 1 includes an elongated main body 11, two primary extension sections 12 and a plurality of primary spacer plates 13. The main body 11 extends in a first direction (D1) (e.g., a front-rear direction, where the arrow is forward-directed). In this embodiment, the main body 11 is configured as an H-beam. The primary extension sections 12 are respectively mounted to two opposite sides of a front portion of the main body 11 in a second direction (D2) perpendicular to the first direction (D1) (e.g., a left-right direction, where the arrow is left-directed), and are adapted to be connected to the building. The primary spacer plates 13 are mounted to the main body 11. In one embodiment, the primary extension sections 12 and the primary spacer plates 13 are welded onto the main body 11.

The secondary core modules 2 are disposed parallel to the primary core module 1, and are respectively disposed at upper and lower notches of the main body 11 that are defined by the H-shaped cross-section and that are opposite in a third direction (D3) perpendicular to the first and second directions (D1, D2). Each of the secondary core modules 2 includes a tubular body 21 that has a rectangular cross-section, and a plurality of secondary spacing plates 22 that are mounted to an outer surrounding surface of the tubular body 21. In the first embodiment, the resilient compression unit (S) is disposed on the secondary core modules 2. The tubular body 21 of each of the secondary core modules 2 includes a first section 21*a* and a second section 21*b* that are disposed in the first direction (D11). The resilient compression unit (S) includes two resilient modules (S1), each of which is disposed between the first section 21*a* and the second section 21*b* of a respective one of the secondary core modules 2.

For the sake of brevity, only one resilient module (S1) and the corresponding secondary core module 2 is described in this paragraph. The resilient module (S1) includes first and second mounting plates (S11, S12) that are respectively mounted to the first section 21*a* and the second section 21*b* of the tubular body 21 by, for example, welding, a partition plate (S13) that is located between the first and second mounting plates (S11, S12), an installation rod (S14) that extends through the first mounting plate (S11), the partition plate (S13) and the second mounting plate (S12), and a plurality of disc springs (S15) that are sleeved on the installation rod (S14). Two opposite end portions of the installation rod (S14) are respectively provided with two limiting members (S16) that are respectively located in front of the first mounting plate (S11) and in back of the second mounting plate (S12). The limiting members (S16) may exemplarily be bolts that serve for limiting a distance between first and second mounting plates (S11, S12). The disc springs (S15) are divided into two groups by the partition plate (S13) that are respectively located between the first mounting plate (S11) and the partition plate (S13) and between the partition plate (S13) and the second mounting plate (S12).

It should be noted that, in one embodiment, the disc springs (S15) may be substituted by springs of other configurations. In addition, each of the resilient modules (S1) may be constituted by other components that are able to be resiliently compressed.

The housing module 3 includes an outer tubular body 31 that extends in the first direction (D1) and that surrounds the primary core module 1 and the secondary core modules 2, and two housing extension sections 32 that are respectively mounted to two opposite sides of a rear portion of the outer tubular body 31 in the second direction (D2) and that are adapted to be connected to the building.

The primary spacer plates 13 of the primary core module 1 serve to maintain relative positions among the main body 11 of the primary core module 1, the tubular body 21 of each of the secondary core modules 2 and the outer tubular body 31 of the housing module 3 in the second direction (D2). The secondary spacer plates 22 of the secondary core modules 2 serve to maintain relative positions among the main body 11 of the primary core module 1, the tubular body 21 of each of the secondary core modules 2 and the outer tubular body 31 of the housing module 3 in the third direction (D3). As such, the main body 11 of the primary core module 1, the tubular body 21 of each of the secondary core modules 2 and the outer tubular body 31 of the housing module 3 are movable relative to each other only in the first direction (D1).

The energy dissipation unit (E) dissipates kinetic energy during the relative movement between the primary core module 1 and the housing module 3. In this embodiment, the energy dissipation unit (E) includes two energy dissipation steel plates (E1) that are respectively mounted to the opposite sides of the front portion of the main body 11 in the second direction (D2) and that are located in back of the primary extension sections 12, two through grooves (E2) that are respectively formed in two opposite sides of a front portion of the outer tubular body 31 of the housing module 3 in the second direction (D2) and that respectively permit the energy dissipation steel plates (E1) to extend therethrough, two pairs of steel angles (E3) each of which is disposed at a respective one of the opposite sides of a front portion of the outer tubular body 31, and the steel angles (E3) in each pair are located at two opposite sides of a corresponding one of the through grooves (E2) in the third direction (D3). The energy dissipation unit (E) further has a plurality of fastener assemblies (E4) connected to the steel angles (E3). In one embodiment, each of the fastener assemblies (E4) may be an assembly of screw E41 and nut (E42), and enables a pair of the steel angles (E3) to clamp the corresponding energy dissipation steel plate (E1).

The first outer plate 6 and the second outer plate 7 are respectively disposed at front and rear end portions of the main body 11 of the primary core module 1 and the outer tubular body 31 of the housing module 3 in the first direction (D1). The first inner plate 4 and the second inner plate 5 are respectively disposed at front and rear end portions of the tubular body 21 of each of the secondary core modules 2 in the first direction (D1). The first outer plate 6 is ring-shaped, and defines a first retaining space 61 therein. The second outer plate 7 is ring-shaped, and defines a second retaining space 71 therein. The first inner plate 4 and the second inner plate 5 are respectively retained in the first retaining space 61 and the second retaining space 71.

The first preload tension members 8 extend in the extending direction of the outer tubular body 31 (i.e., the first direction (D1)), and extend through the tubular bodies 21 of the secondary core modules 2 (i.e., extend through the outer tubular body 31 of the housing module 3). A front end portion of each of the first preload tension members 8 extends through the first inner plate 4. A rear end portion of each of the first preload tension members 8 extends through the second inner plate 5. The front and rear end portions of each of the first preload tension members 8 are positioned relative to the first inner plate 4 and the second inner plate 5 by a plurality of limiting members 81 that are located at outer sides of the first inner plate 4 and the second inner plate 5 in the first direction (D1), such that each of the first preload tension members 8 is preloaded with a tension force. The second preload tension members 9 extend in the extending direction of the outer tubular body 31 (i.e., the first direction (D1)), and extend through the outer tubular body 31 of the housing module 3. A front end portion of each of the second preload tension members 9 extends through the first outer plate 6. A rear end portion of each of the second preload tension members 9 extends through the second outer plate 7. The front and rear end portions of each of the second preload tension members 9 are positioned relative to the first outer plate 6 and the second outer plate 7 by a plurality of limiting members 91 that are located at outer sides of the first outer plate 6 and the second outer plate 7 in the first direction (D1), such that each of the second preload tension members 9 is preloaded with a tension force.

Figure 2:
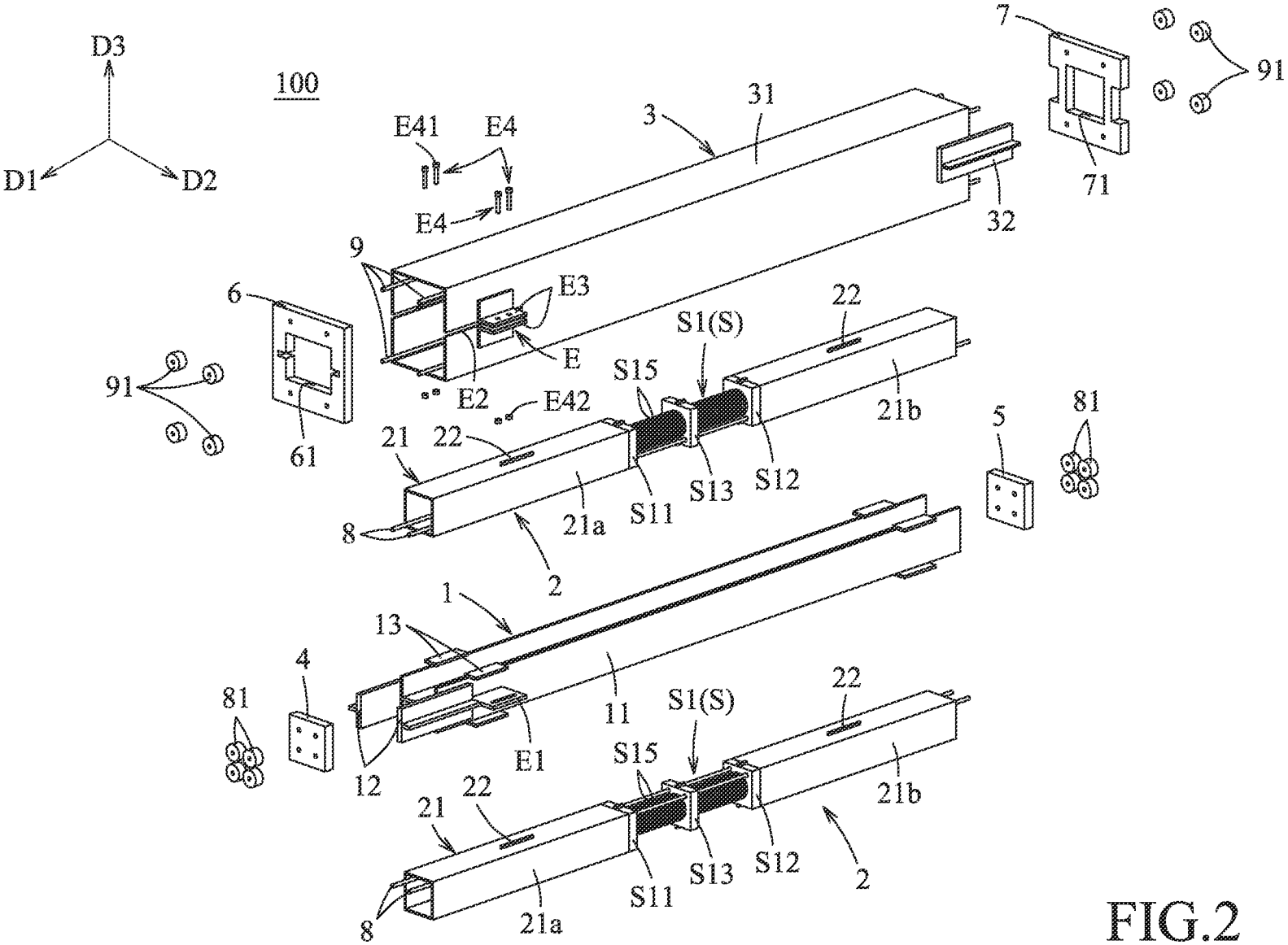
FIG. 2 is an exploded perspective view illustrating the first embodiment.
Figure 3:
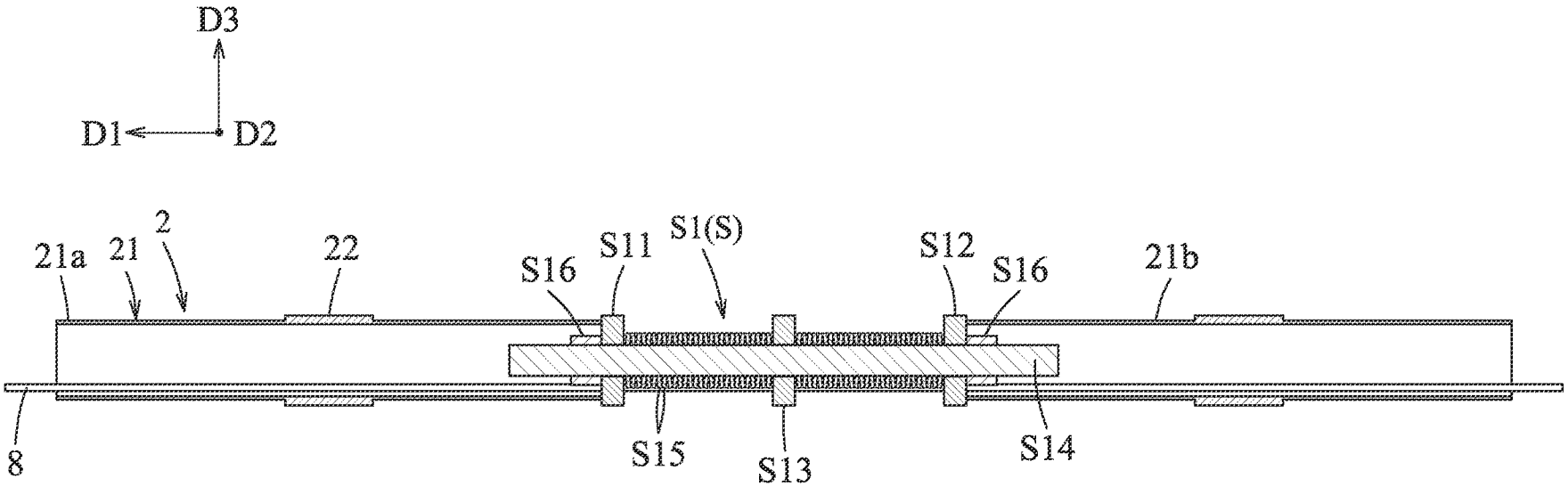
FIG. 3 is a sectional view illustrating the first embodiment.
Figure 4:
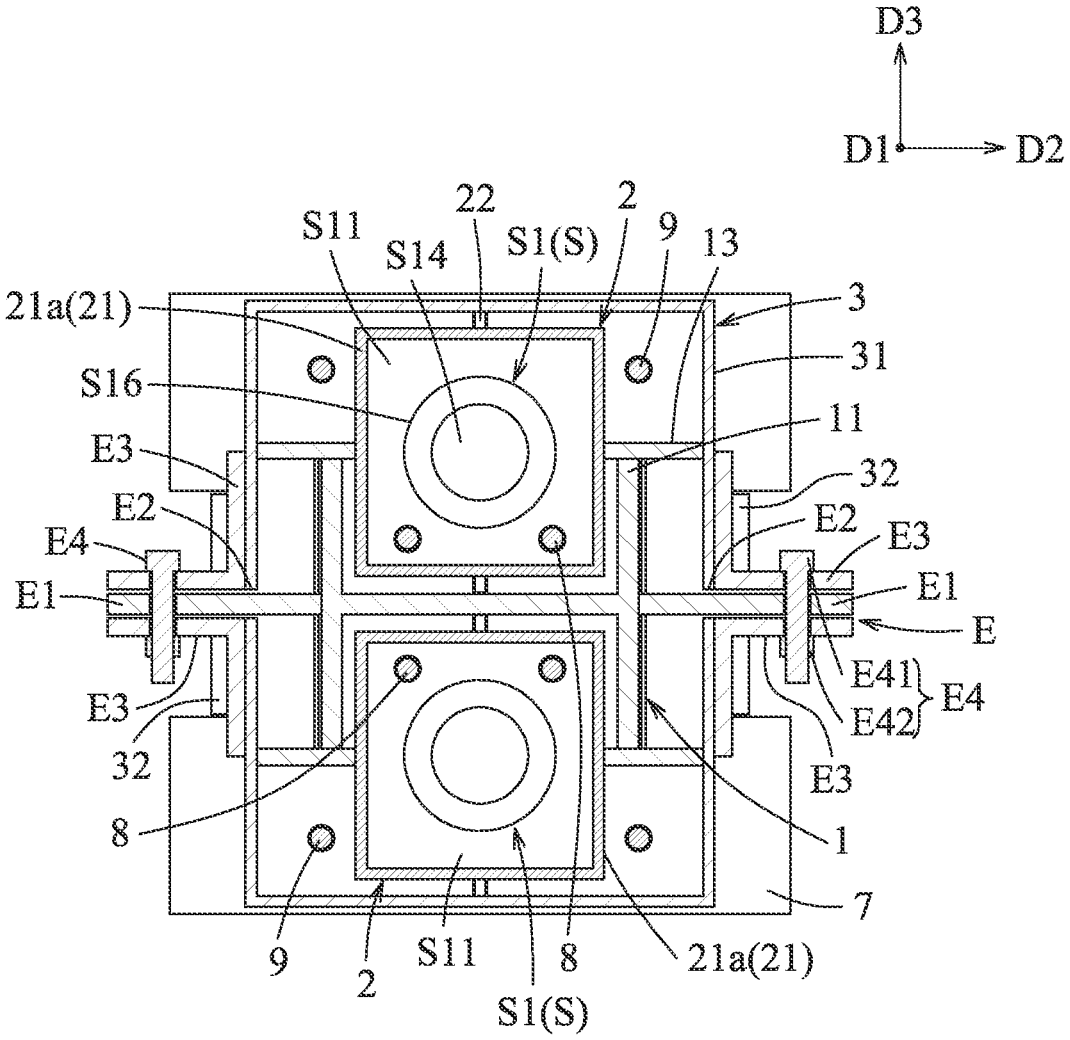
FIG. 4 is another sectional view illustrating the first embodiment.
Figure 5:
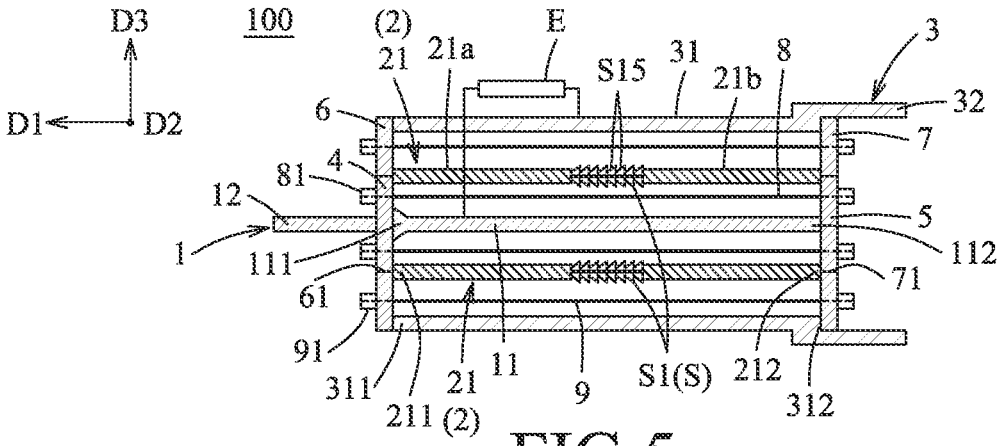
FIG. 5 is a schematic view illustrating the first embodiment subjected to no external force.

Referring to FIGS. 2 and 5, when the primary extension sections 12 of the primary core module 1 and the housing extension sections 32 of the housing module 3 are not subjected to an external force, a first push portion 111 and a second push portion 112 of the main body 11 of the primary core module 1 respectively and directly contact the first inner plate 4 and the second inner plate 5, a first push portion 311 and a second push portion 312 of the outer tubular body 31 of the housing module 3 respectively and directly contact the first outer plate 6 and the second outer plate 7, and a first push portion 211 and a second push portion 212 of the tubular body 21 of each of the secondary core modules 2 respectively and directly contact the first inner plate 4 and the second inner plate 5 and respectively and directly contact the first outer plate 6 and the second outer plate 7. At this time, the energy dissipation device 100 is not deformed.

Figure 6:
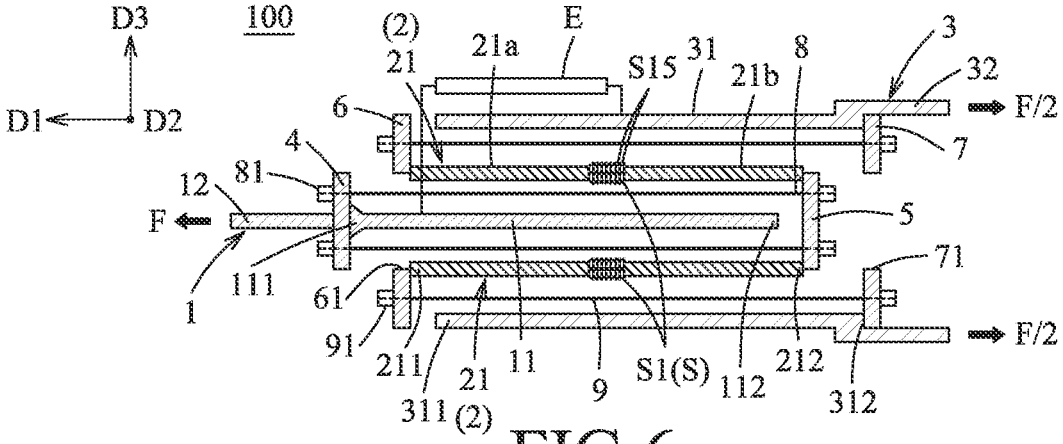
FIG. 6 is another schematic view illustrating the first embodiment subjected to a tension force.

Referring to FIGS. 2 and 6, when the primary extension sections 12 of the primary core module 1 and the housing extension sections 32 of the housing module 3 are subjected to a tension force (F) via the building, the first push portion 111 of the main body 11 of the primary core module 1 pushes the first inner plate 4 forwardly, the second push portion 312 of the outer tubular body 31 of the housing module 3 pushes the second outer plate 7, and the first push portion 211 and the second push portion 212 of the tubular body 21 of each of the secondary core modules 2 respectively push the first outer plate 6 and the second inner plate 5 such that the tubular body 21 of each of the secondary core modules 2 is subjected to a compression force. In this state, the first preload tension members 8 and the second preload tension members 9 are stretched by the tension force, and the disc springs (S15) of the resilient modules (S1) of the resilient compression unit (S) are compressed, so that the primary core module 1 and the housing module 3 are moved relative to each other and that the housing module 3 and the first outer plate 6 are moved relative to each other. At this time, a distance between the primary extension sections 12 of the primary core module 1 and the housing extension sections 32 of the housing module 3 increases, and the energy dissipation device 100 is defined to be positively deformed.

Figure 7:
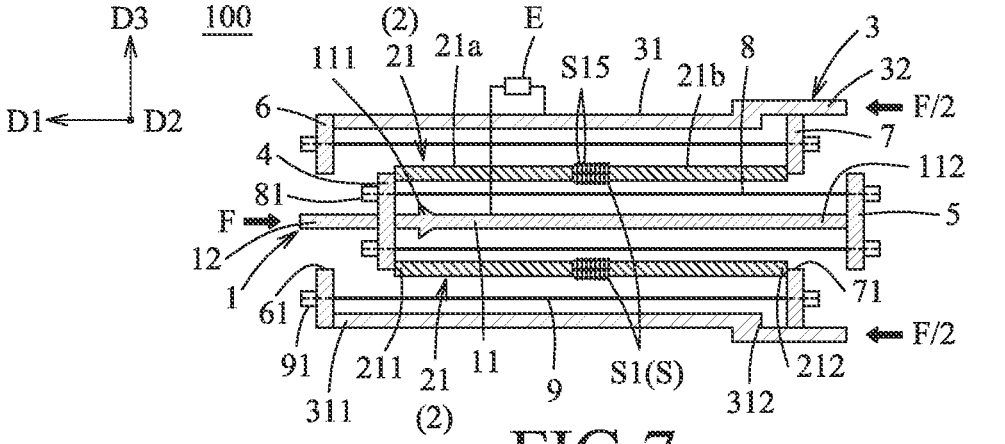
FIG. 7 is still another schematic view illustrating the first embodiment subjected to a compression force.

Referring to FIGS. 2 and 7, when the primary extension sections 12 of the primary core module 1 and the housing extension sections 32 of the housing module 3 are subjected to a compression force (F) via the building, the second push portion 112 of the main body 11 of the primary core module 1 pushes the second inner plate 5 rearwardly, the first push portion 311 of the outer tubular body 31 of the housing module 3 pushes the first outer plate 6, and the first push portion 211 and the second push portion 212 of the tubular body 21 of each of the secondary core modules 2 respectively push the first inner plate 4 and the second outer plate 7 such that the tubular body 21 of each of the secondary core modules 2 is subjected to a compression force. In this state, the first preload tension members 8 and the second preload tension members 9 are stretched by the compression force, and the disc springs (S15) of the resilient modules (S1) of the resilient compression unit (S) are compressed, so that the primary core module 1 and the housing module 3 are moved relative to each other and that the housing module 3 and the second outer plate 7 are moved relative to each other. At this time, a distance between the primary extension sections 12 of the primary core module 1 and the housing extension sections 32 of the housing module 3 decreases, and the energy dissipation device 100 is defined to be negatively deformed.

Regardless of whether the deformation of the energy dissipation device 100 is positive or negative, the energy dissipation unit (E) generates a retarding force during the relative movement between the primary core module 1 and the housing module 3, so as to dissipate the kinetic energy generated as a result of the tension and compression forces. Specifically, the energy dissipation device 100 employs the first preload tension members 8 and the second preload tension members 9 that are stretched under application of the tension or compression forces, and enables the relative movement between the primary core module 1 and the housing module 3 and the relative movement between the housing module 3 and the first outer plate 6 or the second outer plate 7, so the kinetic energy is dissipated by the retarding force generated by the energy dissipation unit (E) during the relative movement between the primary core module 1 and the housing module 3. By virtue of the resilient compression unit (S), the displacement between the primary core module 1 and the housing module 3 is relatively large, so the energy dissipation unit (E) is able to dissipate more kinetic energy generated as a result of the tension and compression forces.

Figure 8:
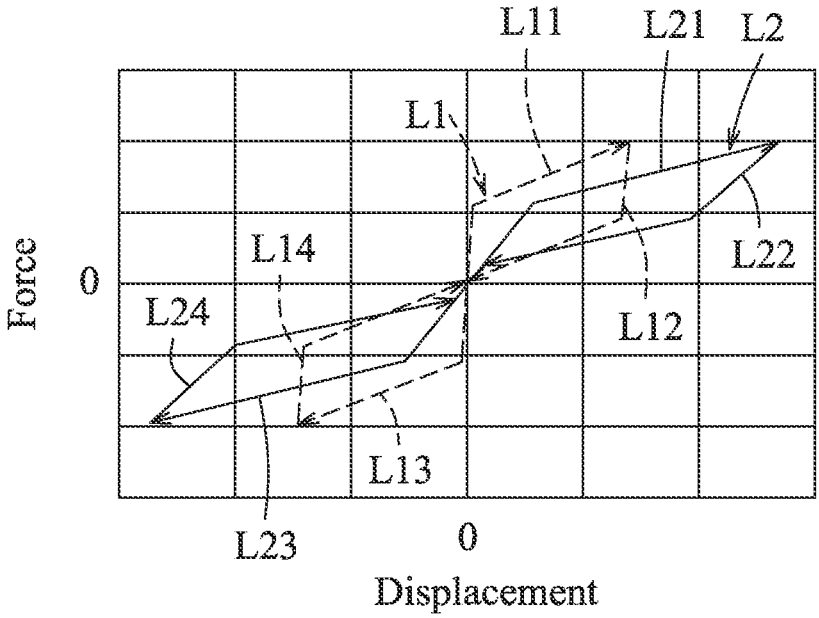
FIG. 8 is a force-displacement diagram illustrating the behavior of the first embodiment.

With further reference to FIG. 8, which depicts force-displacement diagrams of the energy dissipation device 100 with and without the resilient compression unit (S). The dotted broken line (L1) denotes a force-displacement diagram of the energy dissipation device 100 without the resilient compression unit (S), and the solid line (L2) denotes a force-displacement diagram of the energy dissipation device 100 with the resilient compression unit (S) (i.e., the first embodiment). The variation of the force is to simulate the tension and compression forces that are alternately generated during earthquakes. The dotted broken line (L1) includes a first line section (L1*l*) that depicts the behavior when the tension force is gradually increased, a second line section (L12) that depicts the behavior when the tension force is gradually decreased, a third line section (L13) that depicts the behavior when the compression force is gradually increased, and a fourth line section (L14) that depicts the behavior when the compression force is gradually decreased. Similarly, the solid line (L2) includes a first line section (L21) that depicts the behavior when the tension force is gradually increased, a second line section (L22) that depicts the behavior when the tension force is gradually decreased, a third line section (L23) that depicts the behavior when the compression force is gradually increased, and a fourth line section (L24) that depicts the behavior when the compression force is gradually decreased.

It can be observed from FIG. 8 that the slopes of the first line section (L21), the second line section (L22), the third line section (L23) and the fourth line section (L24) of the solid line (L2) are respectively smaller than those of the first line section (L11), the second line section (L12), the third line section (L13) and the fourth line section (L14) of the dotted broken line (L1). It can be comprehended that the resilient compression unit (S) functions to reduce the stiffness of the energy dissipation device 100. In other words, when subjected to the same tension and compression forces, the deformation of the energy dissipation device 100 with the resilient compression unit (S) in the first direction (D1) is larger. In addition, the stiffness of the energy dissipation device 100 can be adjusted by modifying the resilient compression unit (S). By virtue of the resilient compression unit (S), an area bounded by the first line section (L21) and the second line section (L22) of the solid line (L2) is larger than that bounded by the first line section (11) and the second line section (L12) of the dotted broken line (L1), and an area bounded by the third line section (L23) and the fourth line section (L24) of the solid line (L2) is larger than that bounded by the third line section (L13) and the fourth line section (L14) of the dotted broken line (L1). As such, more kinetic energy generated as a result of the tension and compression forces is dissipated by the energy dissipation device 100 with the resilient compression unit (S). In summary, by virtue of the resilient compression unit (S), the stiffness of the energy dissipation device 100 is adjustable, and the displacement between the primary core module 1 and the housing module 3 is relatively large, so the energy dissipation unit (E) is able to dissipate more kinetic energy generated as a result of the tension and compression forces.

Figure 9:
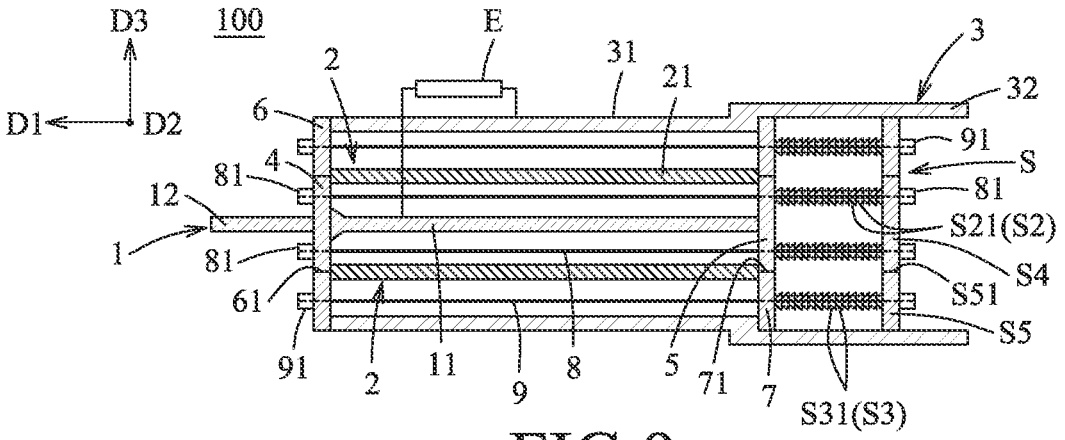
FIG. 9 is a schematic view illustrating a second embodiment of the energy dissipation device according to the disclosure subjected to no external force.

Referring to FIG. 9, a second embodiment of the energy dissipation device 100 according to the disclosure is different from the first embodiment in that: the resilient compression unit (S) is disposed on the first preload tension members 8 and the second preload tension members 9. In this embodiment, the resilient compression unit (S) includes a plurality of first resilient members (S2) that respectively correspond to the first preload tension members 8, a plurality of second resilient members (S3) that respectively correspond to the second preload tension members 9, a plate-shaped first support member (S4), and a plate-shaped second support member (S5). The second support member (S5) is ring-shaped, and defines a retaining space (S51) therein. The first support member (S4) is retained in the retaining space (S51) of the second support member (S5). Each of the first resilient members (S2) includes a plurality of disc springs (S21). Each of the second resilient members (S3) includes a plurality of disc springs (S31). A rear end portion of each of the first preload tension members 8 extends through the second inner plate 5, extends through a respective one of the first resilient members (S2), and is positioned relative to the first support member (S4) by a limiting member 81 that is located in back of the first support member (S4). The first resilient members (S2) are sandwiched between the first support member (S4) and the second inner plate 5 through which the first preload tension members 8 extend. A rear end portion of each of the second preload tension members 9 extends through the second outer plate 7, extends through a respective one of the second resilient members (S3), and is positioned relative to the second support member (S5) by a limiting member 91 that is located in back of the second support member (S5). The second resilient members (S3) are sandwiched between the second support member (S5) and the second outer plate 7 through which the second preload tension members 9 extend.

Figure 10:
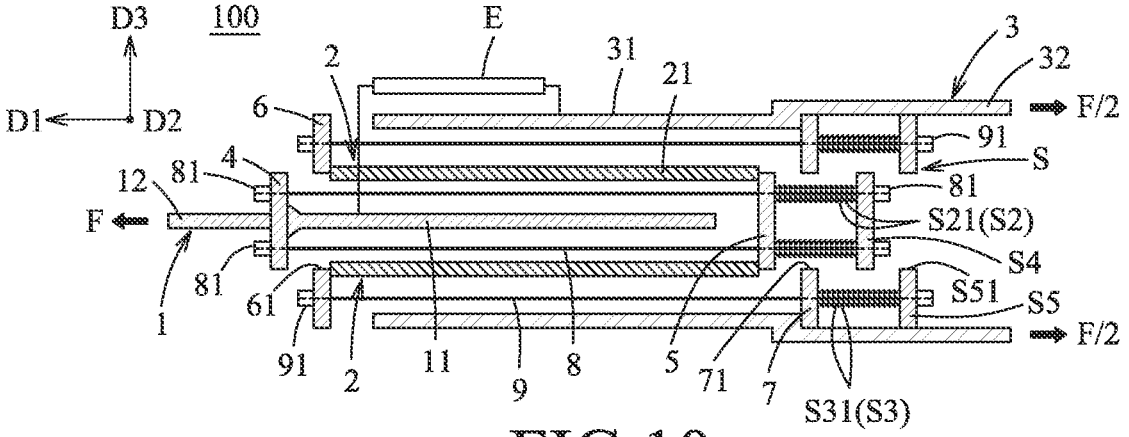
FIG. 10 is another schematic view illustrating the second embodiment subjected to a tension force.

Referring to FIG. 10, when the primary extension sections 12 of the primary core module 1 and the housing extension sections 32 of the housing module 3 are subjected to a tension force (F) via the building, the first preload tension members 8 and the second preload tension members 9 are stretched by the tension force, and the second inner plate 5 and the second outer plate 7 are pushed to respectively approach the first support member (S4) and the second support member (S5), such that the disc springs (S21) of the first resilient members (S2) and the disc springs (S31) of the second resilient members (S3) are compressed and that the primary core module 1 and the housing module 3 are moved relative to each other. At this time, a distance between the primary extension sections 12 of the primary core module 1 and the housing extension sections 32 of the housing module 3 increases, and the energy dissipation device 100 is defined to be positively deformed.

Figure 11:
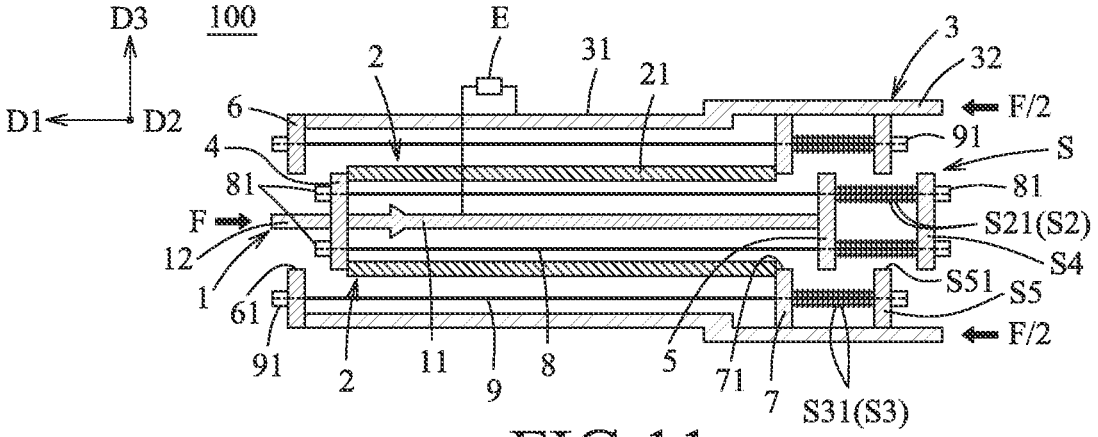
FIG. 11 is still another schematic view illustrating the second embodiment subjected to a compression force.

Referring to FIG. 11, when the primary extension sections 12 of the primary core module 1 and the housing extension sections 32 of the housing module 3 are subjected to a compression force (F) via the building, the first preload tension members 8 and the second preload tension members 9 are stretched by the compression force, and the second inner plate 5 and the second outer plate 7 are pushed to respectively approach the first support member (S4) and the second support member (S5), such that the disc springs (S21) of the first resilient members (S2) and the disc springs (S31) of the second resilient members (S3) are compressed and that the primary core module 1 and the housing module 3 are moved relative to each other. At this time, a distance between the primary extension sections 12 of the primary core module 1 and the housing extension sections 32 of the housing module 3 decreases, and the energy dissipation device 100 is defined to be negatively deformed.

It should be noted that, in a modification of the second embodiment, either one of an assembly of the first resilient members (S2) and the first support member (S4) and an assembly of the second resilient members (S3) and the second support member (S5) may be omitted.

In addition, the assembly of the first resilient members (S2) and the first support member (S4) may be disposed at the first inner plate 4, and the assembly of the second resilient members (S3) and the second support member (S5) may be disposed at the first outer plate 6. Specifically, a front end portion of each of the first preload tension members 8 extends through the first inner plate 4, extends through a respective one of the first resilient members (S2), and is positioned relative to the first support member (S4). The first resilient members (S2) are sandwiched between the first support member (S4) and the first inner plate 4. A front end portion of each of the second preload tension members 9 extends through the first outer plate 6, extends through a respective one of the second resilient members (S3), and is positioned relative to the second support member (S5). The second resilient members (S3) are sandwiched between the second support member (S5) and the first outer plate 6.

Figure 12:
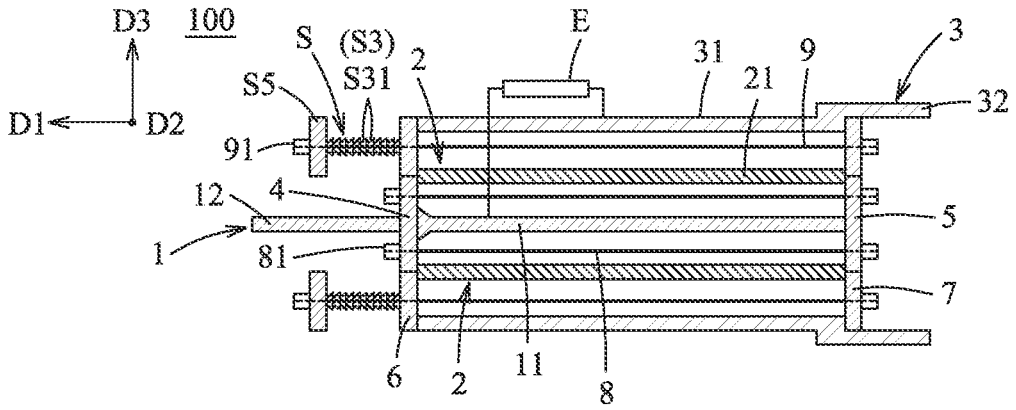
FIG. 12 is a schematic view illustrating a third embodiment of the energy dissipation device according to the disclosure subjected to no external force.

Referring to FIG. 12, a third embodiment of the energy dissipation device 100 according to the disclosure is different from the second embodiment in that: the resilient compression unit (S) is disposed on the second preload tension members 9. In this embodiment, the resilient compression unit (S) includes a plurality of second resilient members (S3) that respectively correspond to the second preload tension members 9, and a second support member (S5) that is configured as a ring-shaped plate. Each of the second resilient members (S3) includes a plurality of disc springs (S31). A rear end portion of each of the first preload tension members 8 is positioned relative to the second inner plate 5. A rear end portion of each of the second preload tension members 9 is positioned relative to the second outer plate 7. A front end portion of each of the second preload tension members 9 extends through the first outer plate 6, extends through a respective one of the second resilient members (S3), and is positioned relative to the second support member (S5) by a limiting member 91 that is located in front of the second support member (35). The second resilient members (S3) are sandwiched between the second support member (S5) and the first outer plate 6.

Figure 13:
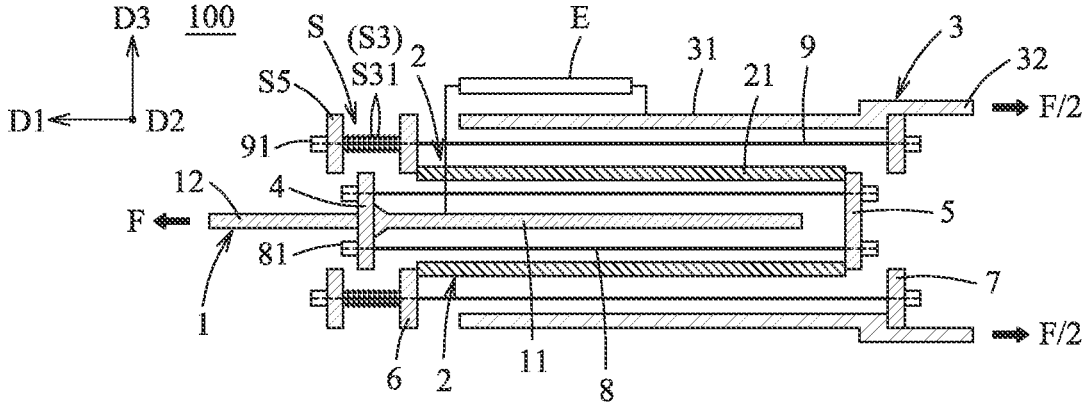
FIG. 13 is another schematic view illustrating the third embodiment subjected to a tension force.

Referring to FIG. 13, when the primary extension sections 12 of the primary core module 1 and the housing extension sections 32 of the housing module 3 are subjected to a tension force (F) via the building, the first preload tension members 8 and the second preload tension members 9 are stretched by the tension force, and the first outer plate 6 is pushed to approach the second support member (S5), such that the disc springs (S31) of the second resilient members (S3) are compressed and that the primary core module 1 and the housing module 3 are moved relative to each other. At this time, a distance between the primary extension sections 12 of the primary core module 1 and the housing extension sections 32 of the housing module 3 increases, and the energy dissipation device 100 is defined to be positively deformed.

Figure 14:
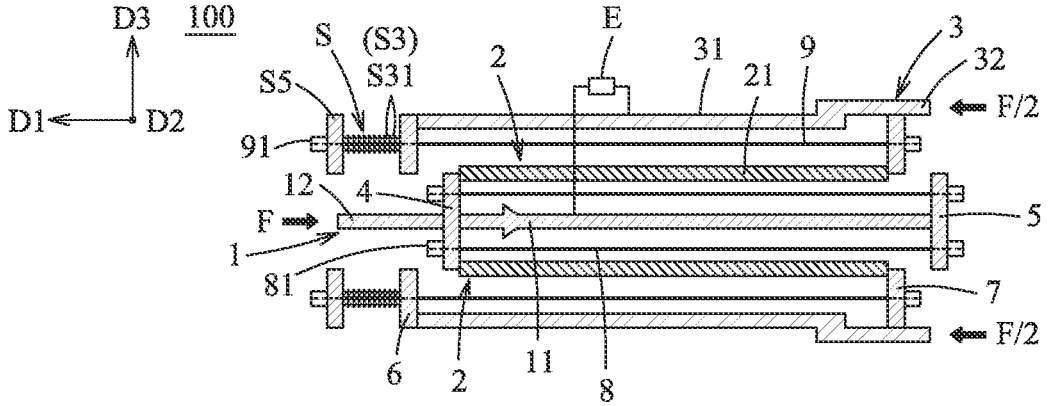
FIG. 14 is still another schematic view illustrating the third embodiment subjected to a compression force.
Figure 15:
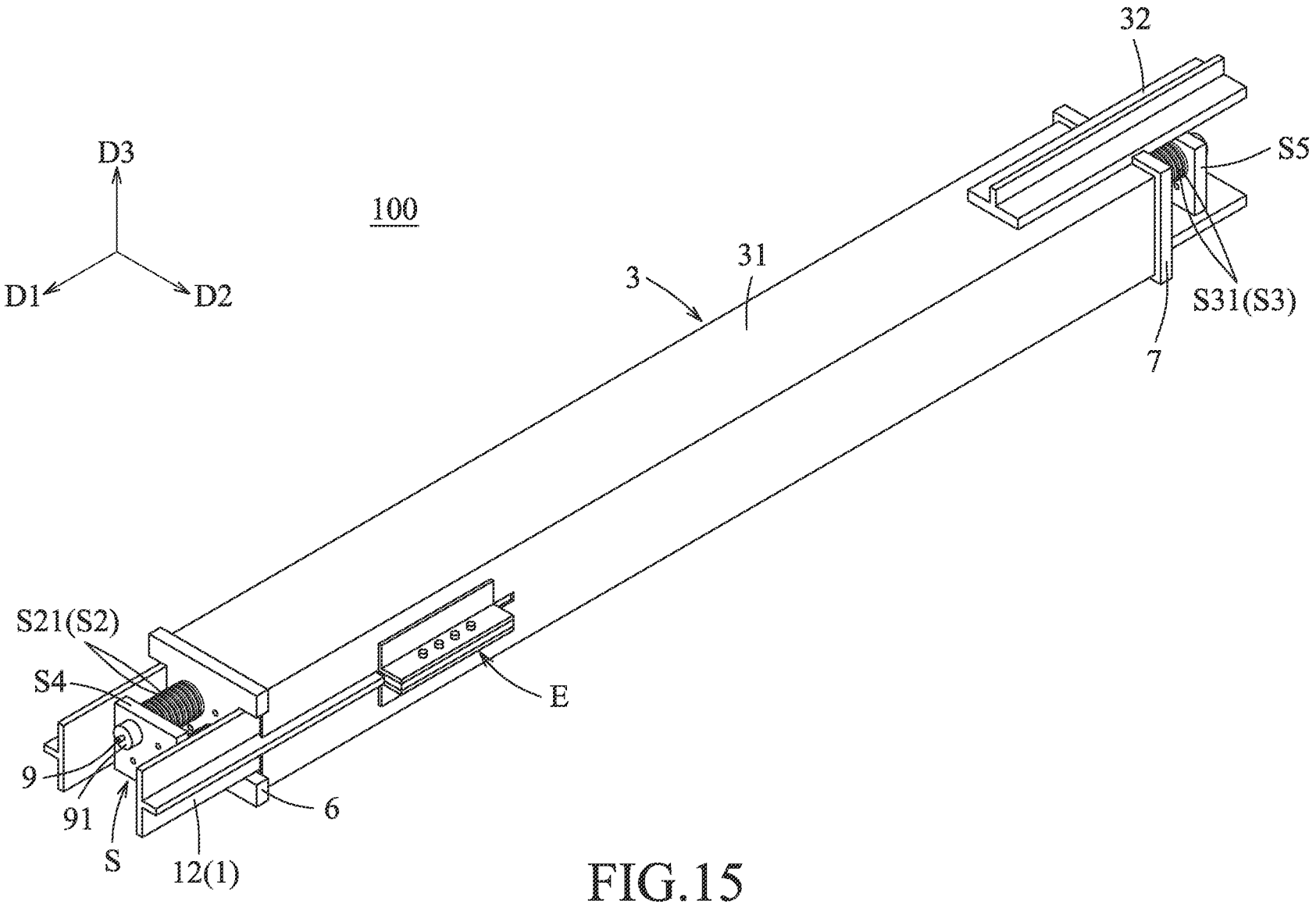
FIG. 15 is a perspective view illustrating a fourth embodiment of the energy dissipation device according to the disclosure.

Referring to FIG. 14, when the primary extension sections 12 of the primary core module 1 and the housing extension sections 32 of the housing module 3 are subjected to a compression force (F) via the building, the first preload tension members 8 and the second preload tension members 9 are stretched by the compression force, and the first outer plate 6 is pushed to approach the second support member (S5), such that the disc springs (S31) of the second resilient members (S3) are compressed and that the primary core module 1 and the housing module 3 are moved relative to each other. At this time, a distance between the primary extension sections 12 of the primary core module 1 and the housing extension sections 32 of the housing module 3 decreases, and the energy dissipation device 100 is defined to be negatively deformed.

Referring to FIGS. 15 to 18, a fourth embodiment of the energy dissipation device 100 according to the disclosure is different from the first embodiment in that: the main body 11 of the primary core module 1 is tubular and has a rectangular cross-section; the number of the secondary core unit 2 is one, and is disposed in the primary core module 1; the first inner plate 4 and the second inner plate 5 are located between the first outer plate 6 and the second outer plate 7; the number of the first preload tension members 8 is two; the number of the second preload tension members 9 is two; and the resilient compression unit (S) is disposed on the first preload tension members 8 and the second preload tension members 9. In this embodiment, the resilient compression unit (S) includes a plurality of first resilient members (S2) that respectively correspond to the second preload tension members 9, a plurality of second resilient members (S3) that respectively correspond to the first preload tension members 8, a plate-shaped first support member (S4), and a plate-shaped second support member (S5). Each of the first resilient members (S2) includes a plurality of disc springs (S21). Each of the second resilient members (S3) includes a plurality of disc springs (S31).

A front end portion of each of the first preload tension members 8 is positioned relative to the first inner plate 4 by a limiting member 81. A rear end portion of each of the first preload tension members 8 extends through the second outer plate 7, extends through a respective one of the second resilient members (S3), and is positioned relative to the second support member (S5) by a limiting member 81. The second resilient members (S3) are sandwiched between the second support member (S5) and the second outer plate 7. A rear end portion of each of the second preload tension members 9 is positioned relative to the second inner plate 5 by a limiting member 91. A front end portion of each of the second preload tension members 9 extends through the first outer plate 6, extends through a respective one of the first resilient members (S2), and is positioned relative to the first support member (S4) by a limiting member 91. The first resilient members (S2) are sandwiched between the first support member (S4) and the first outer plate 6.

Figure 16:
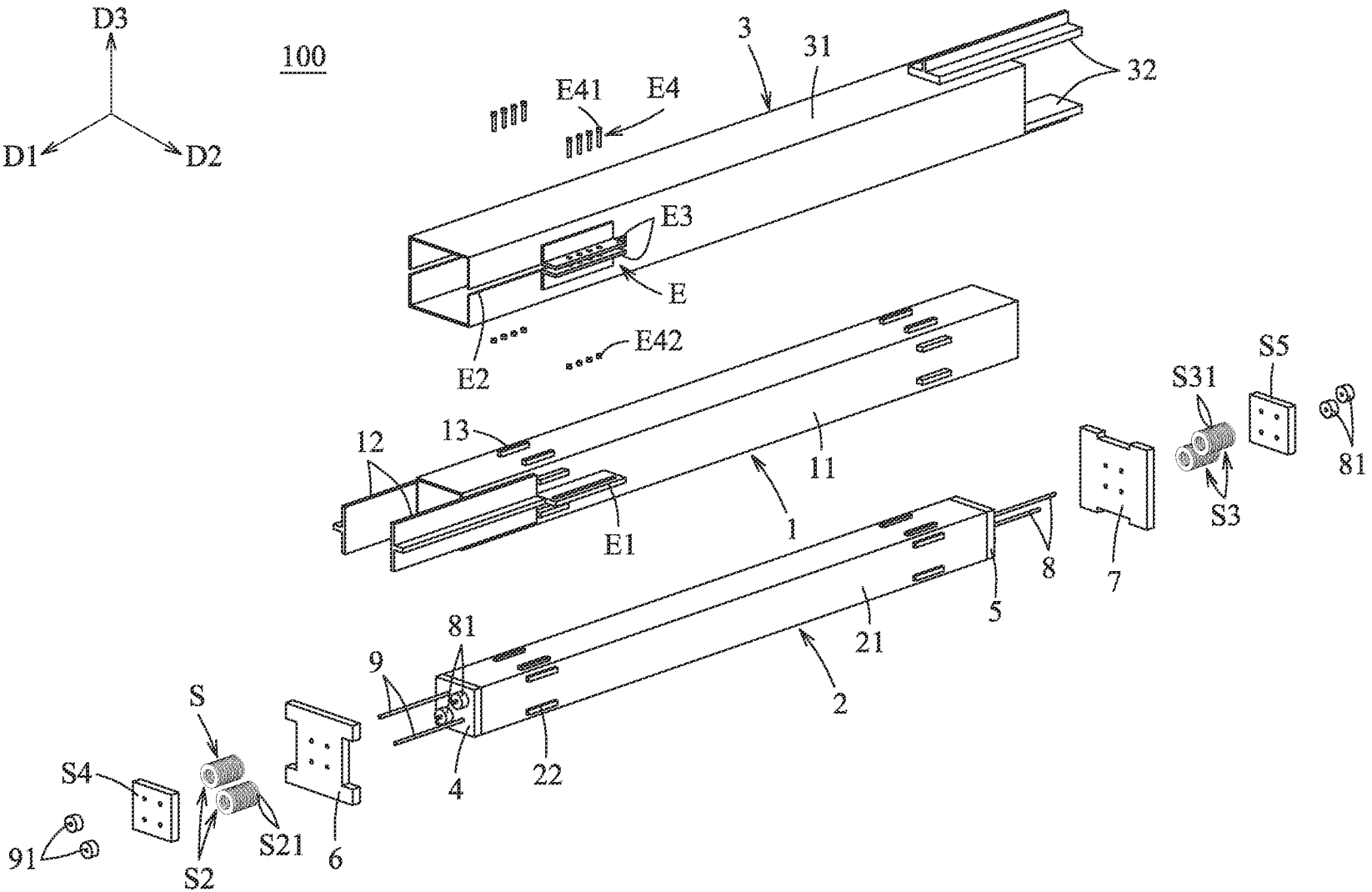
FIG. 16 is an exploded perspective view illustrating the fourth embodiment.
Figure 17:
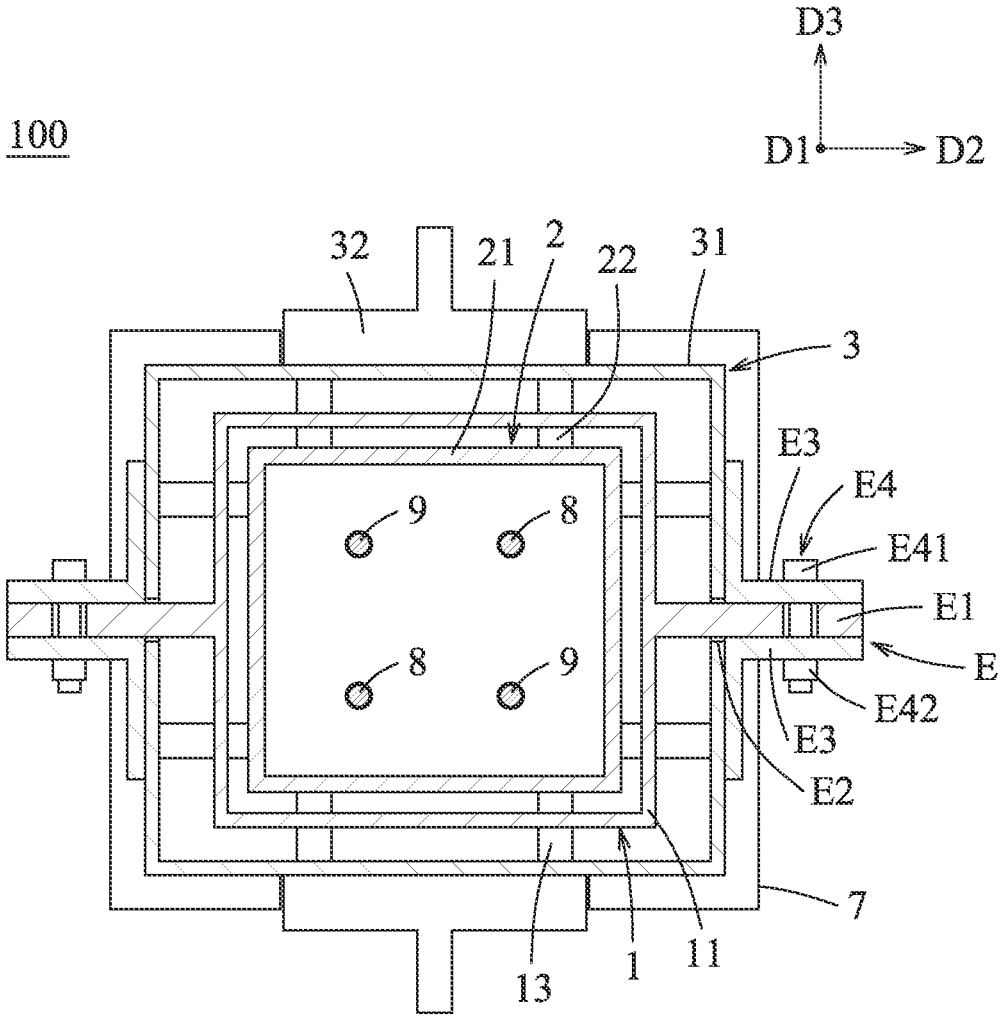
FIG. 17 is a sectional view illustrating the fourth embodiment.
Figure 18:
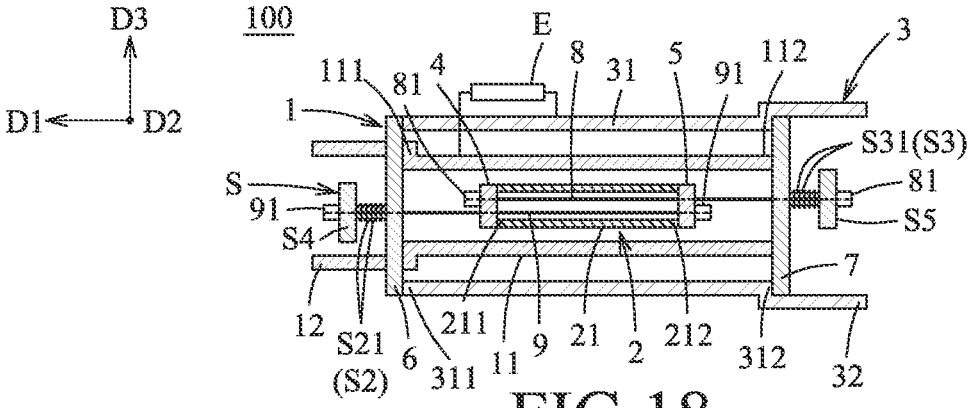
FIG. 18 is a schematic view illustrating the fourth embodiment subjected to no external force.

Referring to FIGS. 16 and 18, when the primary extension sections 12 of the primary core module 1 and the housing extension sections 32 of the housing module 3 are not subjected to an external force, a first push portion 111 and a second push portion 112 of the main body 11 of the primary core module 1 respectively and directly contact the first outer plate 6 and the second outer plate 7, a first push portion 311 and a second push portion 312 of the outer tubular body 31 of the housing module 3 respectively and directly contact the first outer plate 6 and the second outer plate 7, and a first push portion 211 and a second push portion 212 of the tubular body 21 of the secondary core module 2 respectively and directly contact the first inner plate 4 and the second inner plate 5. At this time, the energy dissipation device 100 is not deformed.

Figure 19:
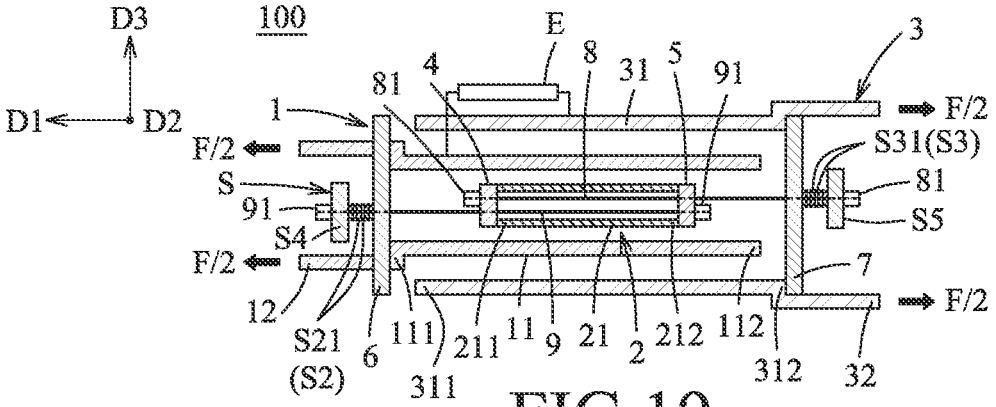
FIG. 19 is another schematic view illustrating the fourth embodiment subjected to a tension force.

Referring to FIG. 19, when the primary extension sections 12 of the primary core module 1 and the housing extension sections 32 of the housing module 3 are subjected to a tension force (F) via the building, the first push portion 111 of the main body 11 of the primary core module 1 pushes the first outer plate 6 forwardly, the second push portion 312 of the outer tubular body 31 of the housing module 3 pushes the second outer plate 7, and the first push portion 211 and the second push portion 212 of the tubular body 21 of the secondary core module 2 respectively push the first inner plate 4 and the second inner plate 5. In this state, the first preload tension members 8 and the second preload tension members 9 are stretched by the tension force, the first outer plate 6 and the second outer plate 7 are pushed to respectively approach the first support member (S4) and the second support member (S5), such that the disc springs (S21) of the first resilient members (S2) and the disc springs (S31) of the second resilient members (S3) are compressed and that the primary core module 1 and the housing module 3 are moved relative to each other. At this time, a distance between the primary extension sections 12 of the primary core module 1 and the housing extension sections 32 of the housing module 3 increases, and the energy dissipation device 100 is defined to be positively deformed.

Figure 20:
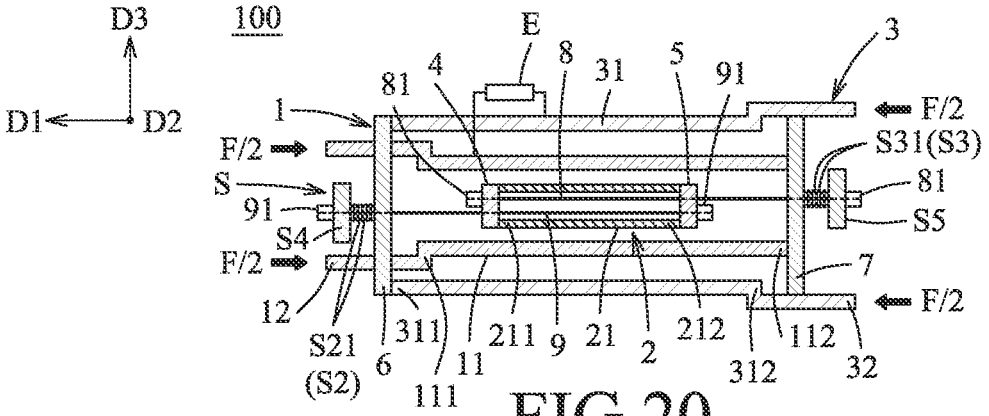
FIG. 20 is still another schematic view illustrating the fourth embodiment subjected to a compression force.

Referring to FIG. 20, when the primary extension sections 12 of the primary core module 1 and the housing extension sections 32 of the housing module 3 are subjected to a compression force (F) via the building, the second push portion 112 of the main body 11 of the primary core module 1 pushes the second outer plate 7 rearwardly, the first push portion 311 of the outer tubular body 31 of the housing module 3 pushes the first outer plate 6, and the first push portion 211 and the second push portion 212 of the tubular body 21 of the secondary core modules 2 respectively push the first inner plate 4 and the second inner plate 5. In this state, the first preload tension members 8 and the second preload tension members 9 are stretched by the compression force, and the first outer plate 6 and the second outer plate 7 are pushed to respectively approach the first support member (S4) and the second support member (S5), such that the disc springs (S21) of the first resilient members (S2) and the disc springs (S31) of the second resilient members (S3) are compressed and that the primary core module 1 and the housing module 3 are moved relative to each other. At this time, a distance between the primary extension sections 12 of the primary core module 1 and the housing extension sections 32 of the housing module 3 decreases, and the energy dissipation device 100 is defined to be negatively deformed.

Figure 21:
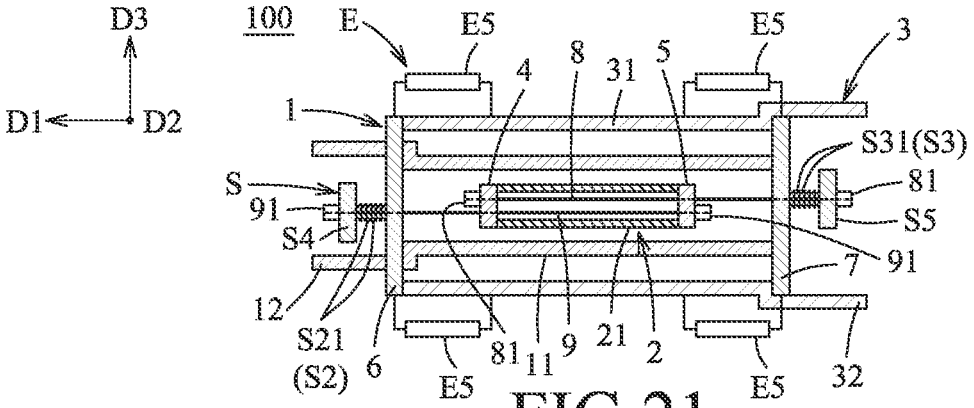
FIG. 21 is a schematic view illustrating a modification of the fourth embodiment subjected to no external force.
Figure 22:
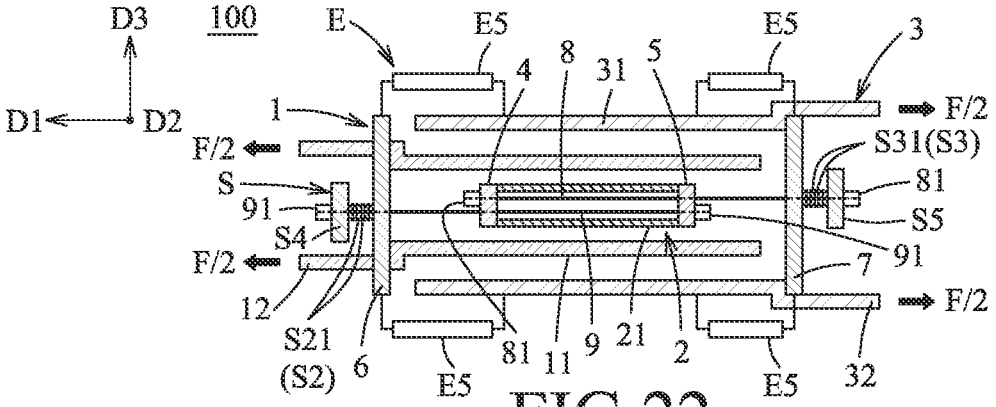
FIG. 22 is another schematic view illustrating the modification of the fourth embodiment subjected to a tension force.
Figure 23:
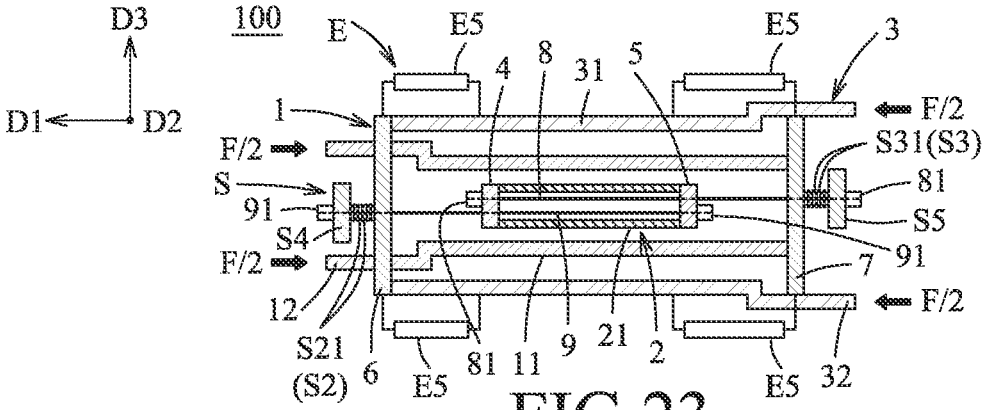
FIG. 23 is still another schematic view illustrating the modification of the fourth embodiment subjected to a compression force.

Referring to FIGS. 21 to 23, in a modification of the fourth embodiment, the energy dissipation unit (E) may be disposed between the outer tubular body 31 of the housing module 3 and the first outer plate 6 and between the outer tubular body 31 of the housing module 3 and the second outer plate 7. Specifically, the energy dissipation unit (E) includes a plurality of energy dissipation bars (E5). Some of the energy dissipation bars (E5) are disposed between the outer tubular body 31 of the housing module 3 and the first outer plate 6, and the others are disposed between the outer tubular body 31 of the housing module 3 and the second outer plate 7. The energy dissipation bars (E5) of the energy dissipation unit (E) generate retarding forces during the relative movement between the housing module 3 and the first outer plate 6 and between the housing module 3 and the second outer plate 7, so as to dissipate the kinetic energy generated as a result of the tension and compression forces. By virtue of the resilient compression unit (S), the displacement between the primary core module 1 and the housing module 3 is relatively large, and the displacement between the housing module 3 and the first outer plate 6 or between the housing module 3 and the second outer plate 7 is relatively large, so the energy dissipation unit (E) is able to dissipate more kinetic energy generated as a result of the tension and compression forces.

Figure 24:
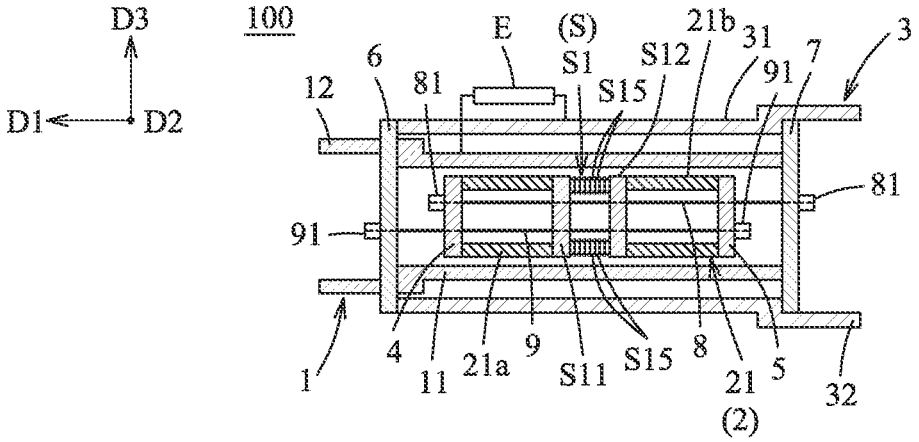
FIG. 24 is a schematic view illustrating a fifth embodiment of the energy dissipation device according to the disclosure subjected to no external force.

Referring to FIG. 24, a fifth embodiment of the energy dissipation device 100 according to the disclosure is different from the fourth embodiment in that the resilient compression unit (S) is disposed on the secondary core module 2. The tubular body 21 of the secondary core module 2 includes a first section 21*a* and a second section 21*b* that are disposed in the first direction (D1). The resilient compression unit (S) includes a resilient module (S1) that is disposed between the first section 21*a* and the second section 21*b* of the secondary core module 2. The resilient module (S1) includes first and second mounting plates (S11, S12) that are respectively mounted to the first section 21*a* and the second section 21*b* of the tubular body 21 by, for example, welding, and a plurality of disc springs (S15) that are sandwiched between the first and second mounting plates (S11, S12). The resilient module (S1) may further include a plurality of installation rods (not shown) that are connected between the first and second mounting plates (S1*l*, S12), and the disc springs (S15) are sleeved on the installation rods so as to be sandwiched between the first and second mounting plates (S11, S12).

A front end portion of each of the first preload tension members 8 is positioned relative to the first inner plate 4 by a limiting member 81. A rear end portion of each of the first preload tension members 8 is positioned relative to the second outer plate 7 by a limiting member 81. A rear end portion of each of the second preload tension members 9 is positioned relative to the second inner plate 5 by a limiting member 91. A front end portion of each of the second preload tension members 9 is positioned relative to the first outer plate 6 by a limiting member 91.

Figure 25:
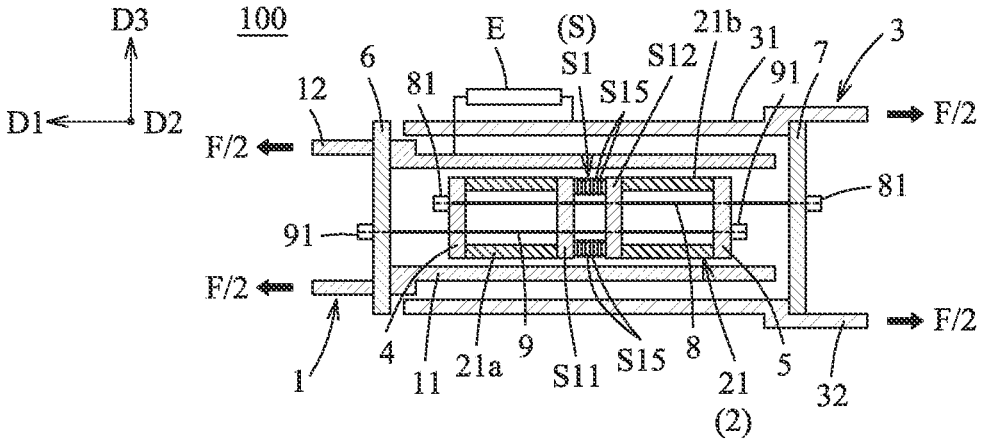
FIG. 25 is another schematic view illustrating the fifth embodiment subjected to a tension force.

Referring to FIG. 25, when the primary extension sections 12 of the primary core module 1 and the housing extension sections 32 of the housing module 3 are subjected to a tension force (F) via the building, the first preload tension members 8 and the second preload tension members 9 are stretched by the tension force, such that the disc springs (S15) of the resilient module (S1) are compressed and that the primary core module 1 and the housing module 3 are moved relative to each other. At this time, a distance between the primary extension sections 12 of the primary core module 1 and the housing extension sections 32 of the housing module 3 increases, and the energy dissipation device 100 is defined to be positively deformed.

Figure 26:
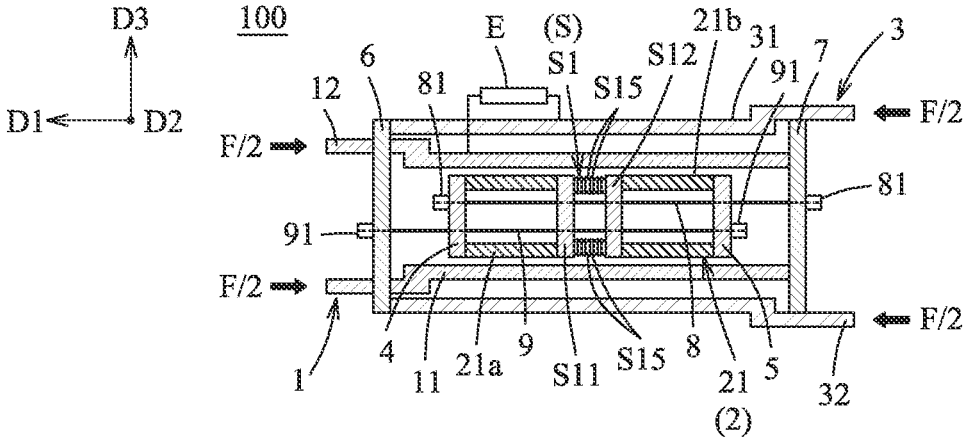
FIG. 26 is still another schematic view illustrating the fifth embodiment subjected to a compression force.

Referring to FIG. 26, when the primary extension sections 12 of the primary core module 1 and the housing extension sections 32 of the housing module 3 are subjected to a compression force (F) via the building, the first preload tension members 8 and the second preload tension members 9 are stretched by the compression force, such that the disc springs (S15) of the resilient module (S1) are compressed and that the primary core module 1 and the housing module 3 are moved relative to each other. At this time, a distance between the primary extension sections 12 of the primary core module 1 and the housing extension sections 32 of the housing module 3 decreases, and the energy dissipation device 100 is defined to be negatively deformed.

Figure 27:
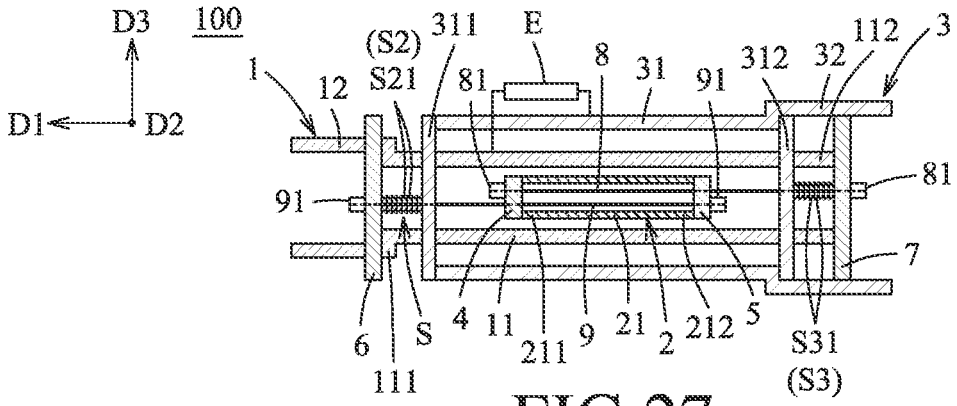
FIG. 27 is a schematic view illustrating a sixth embodiment of the energy dissipation device according to the disclosure subjected to no external force.

Referring to FIG. 27, a sixth embodiment of the energy dissipation device 100 according to the disclosure is different from the fourth embodiment in the configuration of the first push portion 311 and the second push portion 312 of the outer tubular body 31 of the housing module 3. The first push portion 311 and the second push portion 312 of the outer tubular body 31 are located between the first outer plate 6 and the second outer plate 7. A front end portion of each of the first preload tension members 8 is positioned relative to the first inner plate 4 by a limiting member 81. A rear end portion of each of the first preload tension members 8 extends through the second push portion 312 of the outer tubular body 31, extends through a respective one of the second resilient members (S3), and is positioned relative to the second outer plate 7 by a limiting member 81. The second resilient members (S3) are sandwiched between the second push portion 312 of the outer tubular body 31 and the second outer plate 7. A rear end portion of each of the second preload tension members 9 is positioned relative to the second inner plate 5 by a limiting member 91. A front end portion of each of the second preload tension members 9 extends through the first push portion 311 of the outer tubular body 31, extends through a respective one of the first resilient members (S2), and is positioned relative to the first outer plate 6 by a limiting member 91. The first resilient members (S2) are sandwiched between the first outer plate 6 and the first push portion 311 of the outer tubular body 31.

When the primary extension sections 12 of the primary core module 1 and the housing extension sections 32 of the housing module 3 are not subjected to an external force, a first push portion 111 and a second push portion 112 of the main body 11 of the primary core module 1 respectively and directly contact the first outer plate 6 and the second outer plate 7, the first push portion 311 and the second push portion 312 of the outer tubular body 31 of the housing module 3 respectively and indirectly contact the first outer plate 6 and the second outer plate 7 via the first resilient members (S2) and the second resilient members (S3), and a first push portion 211 and a second push portion 212 of the tubular body 21 of the secondary core module 2 respectively and directly contact the first inner plate 4 and the second inner plate 5. At this time, the energy dissipation device 100 is not deformed.

Figure 28:
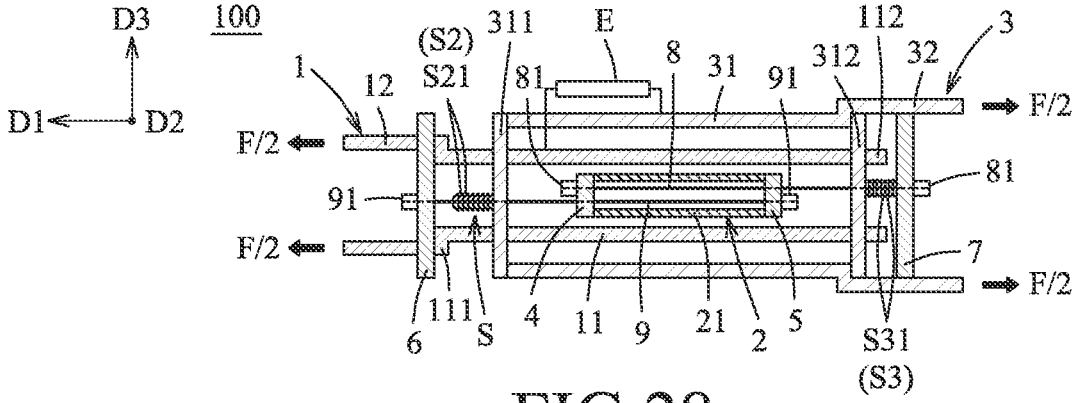
FIG. 28 is another schematic view illustrating the sixth embodiment subjected to a tension force.

Referring to FIG. 28, when the primary extension sections 12 of the primary core module 1 and the housing extension sections 32 of the housing module 3 are subjected to a tension force (F) via the building, the first push portion 111 of the main body 11 of the primary core module 1 pushes the first outer plate 6 forwardly, the second push portion 312 of the outer tubular body 31 of the housing module 3 pushes the second outer plate 7 via the second resilient members (S3), and the first push portion 211 and the second push portion 212 of the tubular body 21 of the secondary core module 2 respectively push the first inner plate 4 and the second inner plate 5. In this state, the first preload tension members 8 and the second preload tension members 9 are stretched by the tension force, the second push portion 312 of the outer tubular body 31 is pushed to approach the second outer plate 7, such that the disc springs (S31) of the second resilient members (S3) are compressed and that the primary core module 1 and the housing module 3 are moved relative to each other. At this time, a distance between the primary extension sections 12 of the primary core module 1 and the housing extension sections 32 of the housing module 3 increases, and the energy dissipation device 100 is defined to be positively deformed.

Figure 29:
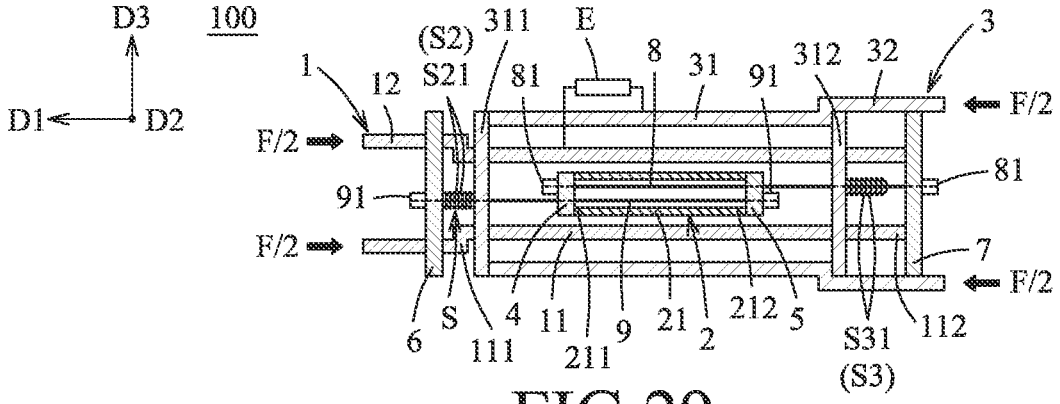
FIG. 29 is still another schematic view illustrating the sixth embodiment subjected to a compression force.

Referring to FIG. 29, when the primary extension sections 12 of the primary core module 1 and the housing extension sections 32 of the housing module 3 are subjected to a compression force (F) via the building, the second push portion 112 of the main body 11 of the primary core module 1 pushes the second outer plate 7 forwardly, the first push portion 311 of the outer tubular body 31 of the housing module 3 pushes the first outer plate 6 via the first resilient members (S2), and the first push portion 211 and the second push portion 212 of the tubular body 21 of the secondary core module 2 respectively push the first inner plate 4 and the second inner plate 5. In this state, the first preload tension members 8 and the second preload tension members 9 are stretched by the compression force, the first push portion 311 of the outer tubular body 31 is pushed to approach the first outer plate 6, such that the disc springs (S21) of the first resilient members (S2) are compressed and that the primary core module 1 and the housing module 3 are moved relative to each other. At this time, a distance between the primary extension sections 12 of the primary core module 1 and the housing extension sections 32 of the housing module 3 decreases, and the energy dissipation device 100 is defined to be negatively deformed.

Figure 30:
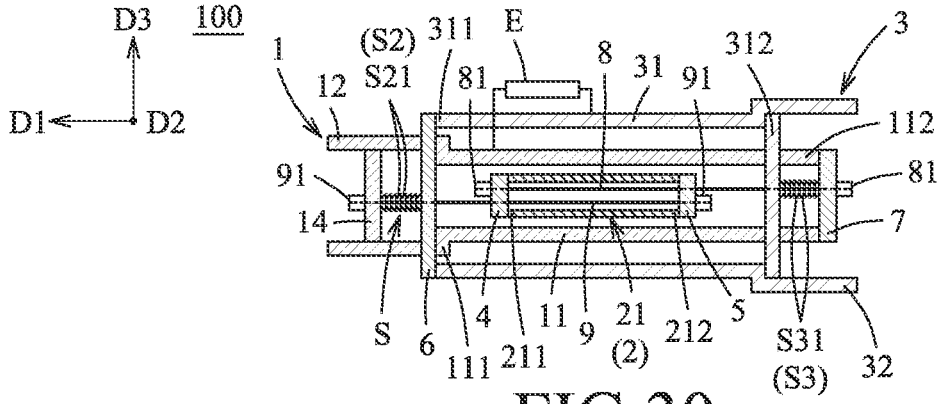
FIG. 30 is a schematic view illustrating a seventh embodiment of the energy dissipation device according to the disclosure subjected to no external force.

Referring to FIG. 30, a seventh embodiment of the energy dissipation device 100 according to the disclosure is different from the fourth embodiment in the configuration of the second push portion 312 of the outer tubular body 31 of the housing module 3. The primary core module 1 further includes a primary support member 14 that is connected between the primary extension sections 12 of the primary core module 1. The second push portion 312 of the outer tubular body 31 is disposed adjacent to the second outer plate 7, and is located between the first outer plate 6 and the second outer plate 7. A front end portion of each of the first preload tension members 8 is positioned relative to the first inner plate 4 by a limiting member 81. A rear end portion of each of the first preload tension members 8 extends through the second push portion 312 of the outer tubular body 31, extends through a respective one of the second resilient members (S3), and is positioned relative to the second outer plate 7 by a limiting member 81. The second resilient members (S3) are sandwiched between the second push portion 312 of the outer tubular body 31 and the second outer plate 7. A rear end portion of each of the second preload tension members 9 is positioned relative to the second inner plate 5 by a limiting member 91. A front end portion of each of the second preload tension members 9 extends through the first outer plate 6, extends through a respective one of the first resilient members (S2), and is positioned relative to the primary support member 14 by a limiting member 91. The first resilient members (S2) are sandwiched between the first outer plate 6 and the primary support member 14.

When the primary extension sections 12 of the primary core module 1 and the housing extension sections 32 of the housing module 3 are not subjected to an external force, a first push portion 111 and a second push portion 112 of the main body 11 of the primary core module 1 respectively and directly contact the first outer plate 6 and the second outer plate 7, a first push portion 311 of the outer tubular body 31 of the housing module 3 directly contacts the first outer plate 6, the second push portion 312 of the outer tubular body 31 of the housing module 3 indirectly contacts the second outer plate 7 via the second resilient members (S3), and a first push portion 211 and a second push portion 212 of the tubular body 21 of the secondary core module 2 respectively and directly contact the first inner plate 4 and the second inner plate 5. At this time, the energy dissipation device 100 is not deformed.

Figure 31:
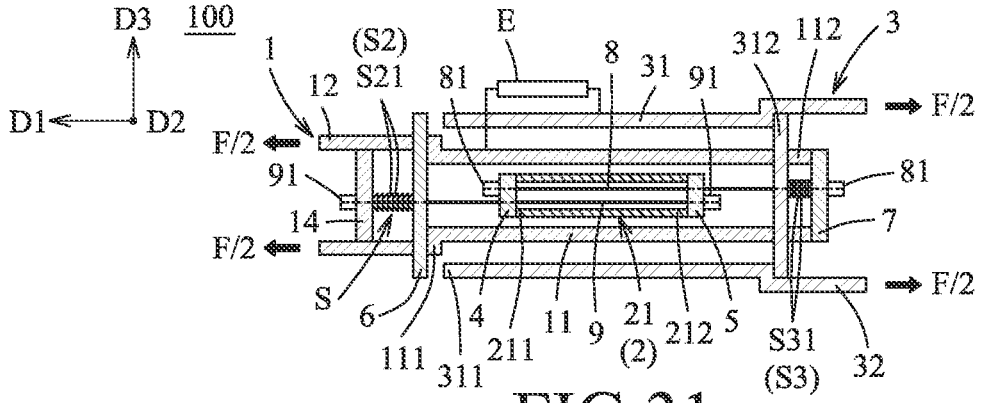
FIG. 31 is another schematic view illustrating the seventh embodiment subjected to a tension force.

Referring to FIG. 31, when the primary extension sections 12 of the primary core module 1 and the housing extension sections 32 of the housing module 3 are subjected to a tension force (F) via the building, the first push portion 111 of the main body 11 of the primary core module 1 pushes the first outer plate 6 forwardly, the second push portion 112 of the main body 11 of the primary core module 1 pushes the second outer plate 7, the second push portion 312 of the outer tubular body 31 of the housing module 3 indirectly pushes the second outer plate 7 via the second resilient members (S3), and the first push portion 211 and the second push portion 212 of the tubular body 21 of the secondary core module 2 respectively push the first inner plate 4 and the second inner plate 5. In this state, the first preload tension members 8 and the second preload tension members 9 are stretched by the tension force, and the second push portion 312 of the outer tubular body 31 is pushed to approach the second outer plate 7, such that the disc springs (S31) of the second resilient members (S3) are compressed and that the primary core module 1 and the housing module 3 are moved relative to each other. At this time, a distance between the primary extension sections 12 of the primary core module 1 and the housing extension sections 32 of the housing module 3 increases, and the energy dissipation device 100 is defined to be positively deformed.

Figure 32:
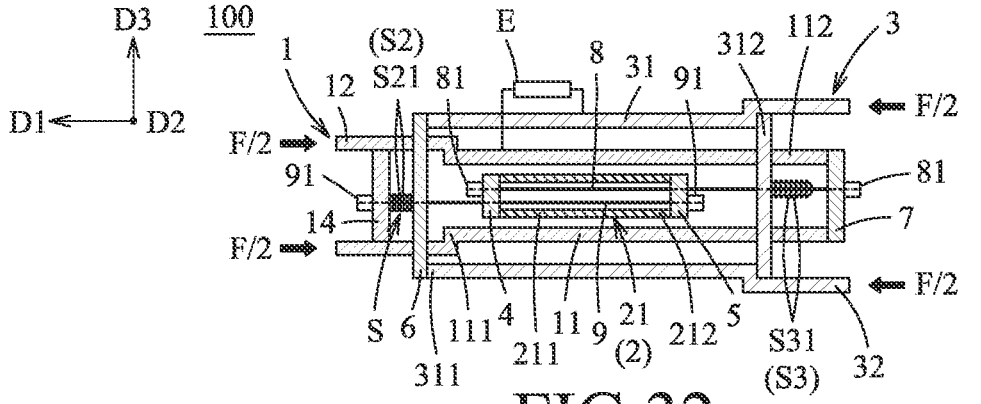
FIG. 32 is still another schematic view illustrating the seventh embodiment subjected to a compression force.

Referring to FIG. 32, when the primary extension sections 12 of the primary core module 1 and the housing extension sections 32 of the housing module 3 are subjected to a compression force (F) via the building, the second push portion 112 of the main body 11 of the primary core module 1 pushes the second outer plate 7, the first push portion 311 of the outer tubular body 31 of the housing module 3 directly pushes the first outer plate 6, and the first push portion 211 and the second push portion 212 of the tubular body 21 of the secondary core module 2 respectively push the first inner plate 4 and the second inner plate 5. In this state, the first preload tension members 8 and the second preload tension members 9 are stretched by the compression force, and the first outer plate 6 is pushed to approach the primary support member 14, such that the disc springs (S21) of the first resilient members (S2) are compressed and that the primary core module 1 and the housing module 3 are moved relative to each other. At this time, a distance between the primary extension sections 12 of the primary core module 1 and the housing extension sections 32 of the housing module 3 decreases, and the energy dissipation device 100 is defined to be negatively deformed.

Figure 33:
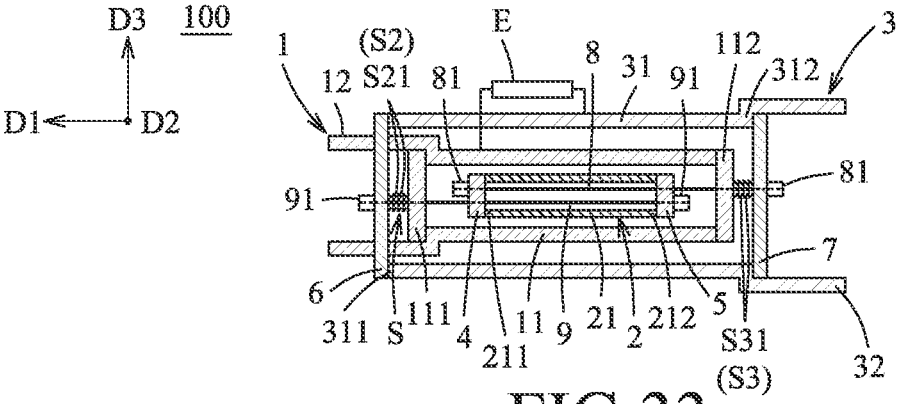
FIG. 33 is a schematic view illustrating an eighth embodiment of the energy dissipation device according to the disclosure subjected to no external force.

Referring to FIG. 33, an eighth embodiment of the energy dissipation device 100 according to the disclosure is different from the fourth embodiment in the configuration of the first push portion 111 and the second push portion 112 of the main body 11 of the primary core module 1. The first push portion 111 and the second push portion 112 of the main body 11 of the primary core module 1 are located between the first outer plate 6 and the second outer plate 7. A front end portion of each of the first preload tension members 8 is positioned relative to the first inner plate 4 by a limiting member 81. A rear end portion of each of the first preload tension members 8 extends through the second push portion 112 of the main body 11 of the primary core module 1, extends through a respective one of the second resilient members (S3), and is positioned relative to the second outer plate 7 by a limiting member 81. The second resilient members (S3) are sandwiched between the second push portion 112 of the main body 11 of the primary core module 1 and the second outer plate 7. A rear end portion of each of the second preload tension members 9 is positioned relative to the second inner plate 5 by a limiting member 91. A front end portion of each of the second preload tension members 9 extends through the first push portion 111 of the main body 11 of the primary core module 1, extends through a respective one of the first resilient members (S2), and is positioned relative to the first outer plate 6 by a limiting member 91. The first resilient members (S2) are sandwiched between the first outer plate 6 and the first push portion 111 of the main body 11 of the primary core module 1.

When the primary extension sections 12 of the primary core module 1 and the housing extension sections 32 of the housing module 3 are not subjected to an external force, the first push portion 111 and the second push portion 112 of the main body 11 of the primary core module 1 respectively and indirectly contact the first outer plate 6 and the second outer plate 7 via the first resilient members (S2) and the second resilient members (S3), a first push portion 311 and a second push portion 312 of the outer tubular body 31 of the housing module 3 directly contacts the first outer plate 6 and the second outer plate 7, and a first push portion 211 and a second push portion 212 of the tubular body 21 of the secondary core module 2 respectively and directly contact the first inner plate 4 and the second inner plate 5. At this time, the energy dissipation device 100 is not deformed.

Figure 34:
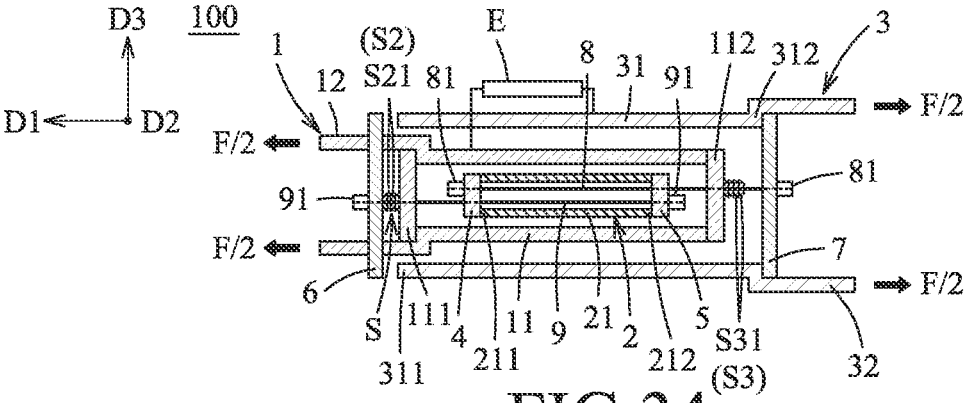
FIG. 34 is another schematic view illustrating the eighth embodiment subjected to a tension force.

Referring to FIG. 34, when the primary extension sections 12 of the primary core module 1 and the housing extension sections 32 of the housing module 3 are subjected to a tension force (F) via the building, the first push portion 111 of the main body 11 of the primary core module 1 indirectly pushes the first outer plate 6 via the first resilient members (S2), the second push portion 312 of the outer tubular body 31 of the housing module 3 directly pushes the second outer plate 7, and the first push portion 211 and the second push portion 212 of the tubular body 21 of the secondary core module 2 respectively push the first inner plate 4 and the second inner plate 5. In this state, the first preload tension members 8 and the second preload tension members 9 are stretched by the tension force, and the first push portion 111 of the main body 11 of the primary core module 1 is pushed to approach the first outer plate 6, such that the disc springs (S21) of the first resilient members (S2) are compressed and that the primary core module 1 and the housing module 3 are moved relative to each other. At this time, a distance between the primary extension sections 12 of the primary core module 1 and the housing extension sections 32 of the housing module 3 increases, and the energy dissipation device 100 is defined to be positively deformed.

Figure 35:
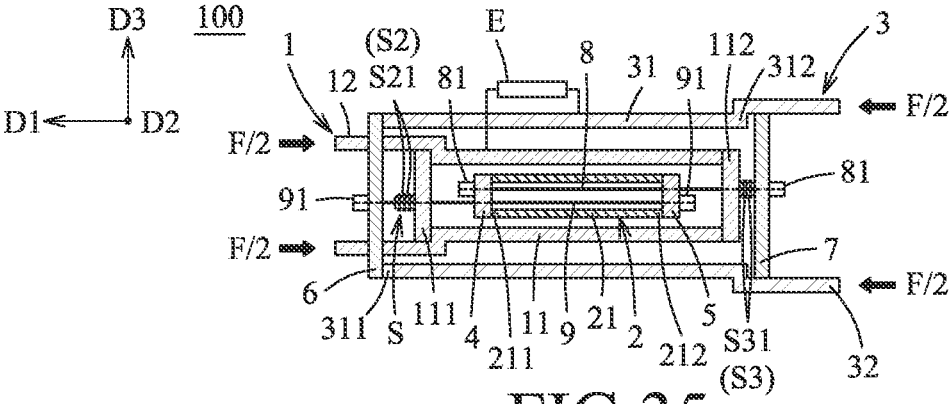
FIG. 35 is still another schematic view illustrating the eighth embodiment subjected to a compression force.

Referring to FIG. 35, when the primary extension sections 12 of the primary core module 1 and the housing extension sections 32 of the housing module 3 are subjected to a compression force (F) via the building, the second push portion 112 of the main body 11 of the primary core module 1 indirectly pushes the second outer plate 7 via the second resilient members (S3), the first push portion 311 of the outer tubular body 31 of the housing module 3 directly pushes the first outer plate 6, and the first push portion 211 and the second push portion 212 of the tubular body 21 of the secondary core module 2 respectively push the first inner plate 4 and the second inner plate 5. In this state, the first preload tension members 8 and the second preload tension members 9 are stretched by the compression force, and the second push portion 112 of the main body 11 of the primary core module 1 is pushed to approach the second outer plate 7, such that the disc springs (S31) of the second resilient members (S3) are compressed and that the primary core module 1 and the housing module 3 are moved relative to each other. At this time, a distance between the primary extension sections 12 of the primary core module 1 and the housing extension sections 32 of the housing module 3 decreases, and the energy dissipation device 100 is defined to be negatively deformed.

In summary, by virtue of the first preload tension members 8 and the second preload tension members 9 that are stretched under application of the tension or compression forces caused by earthquakes, the energy dissipation device 100 according to the disclosure enables the relative movement between the primary core module 1 and the housing module 3 and the relative movement between the housing module 3 and the first outer plate 6 or the second outer plate 7. The energy dissipation unit (E) generates a retarding force during the relative movement between the primary core module 1 and the housing module 3 or during the relative movement between the housing module 3 and the first outer plate 6/the second outer plate 7, so as to dissipate the kinetic energy generated as a result of the tension and compression forces. In addition, by virtue of the resilient compression unit (S), the displacement between the primary core module 1 and the housing module 3 and the displacement between the housing module 3 and the first outer plate 6/the second outer plate 7 are relatively large, so the energy dissipation unit (E) is able to dissipate more kinetic energy generated as a result of the tension and compression forces.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. An energy dissipation device adapted to be installed in a building, comprising:

a primary core module including a main body, and a primary extension section that is mounted to said main body and that is adapted to be connected to the building;

a secondary core module disposed parallel to said primary core module;

a housing module including an outer tubular body that surrounds said primary core module and said secondary core module, and a housing extension section that is mounted to said outer tubular body and that is adapted to be connected to the building;

a first inner plate and a second inner plate respectively disposed at two opposite sides of said secondary core module, said secondary core module having opposite first and second push portions that are respectively in contact with said first inner plate and said second inner plate;

a first outer plate and a second outer plate, said outer tubular body of said housing module having opposite first and second push portions that are respectively in direct or indirect contact with said first outer plate and said second outer plate, said main body of said primary core module having opposite first and second push portions that are respectively in direct or indirect contact with said first inner plate and said second inner plate or with said first outer plate and said second outer plate;

an energy dissipation unit dissipating kinetic energy generated by a relative movement between said primary core module and said housing module, a relative movement between said housing module and said first outer plate or a relative movement between said housing module and said second outer plate;

a first preload tension member extending in the extending direction of said outer tubular body of said housing module, and extending through said outer tubular body, said first preload tension member having an end portion that is connected to said first inner plate, and an opposite end portion that is connected to the one of said second inner plate and said second outer plate which is in contact with said second push portion of said main body of said primary core module;

a second preload tension member extending in the extending direction of said outer tubular body of said housing module, and extending through said outer tubular body, said second preload tension member having an end portion that is connected to said first outer plate, and an opposite end portion that is connected to the other one of said second inner plate and said second outer plate which is not in contact with said second push portion of said main body of said primary core module; and a resilient compression unit disposed on at least one of said secondary core module, said first preload tension member and said second preload tension member;

wherein, when said primary extension section of said primary core module and said housing extension section of said housing module are subjected to an external force, said first preload tension member and said second preload tension member are stretched by the external force, and said resilient compression unit is compressed, such that relative movement between said primary core module and said housing module and relative movement between said housing module and said first outer plate or between said housing module and said second outer plate are generated, said energy dissipation unit generating a retarding force during the relative movement between said primary core module and said housing module or during the relative movement between said housing module and said first outer plate or between said housing module and said second outer plate, so as to dissipate the kinetic energy generated as a result of the external force.

2. The energy dissipation device as claimed in claim 1, wherein said first outer plate is ring-shaped, and defines a first retaining space therein, said second outer plate being ring-shaped, and defining a second retaining space therein, said first inner plate and said second inner plate being respectively retained in said first retaining space and said second retaining space, said first and second push portions of said secondary core module being respectively in contact with said first inner plate and said second inner plate and being respectively in contact with said first outer plate and said second outer plate, said opposite end portion of said first preload tension member being connected to said second inner plate, said opposite end portion of said second preload tension member being connected to said second outer plate.

3. The energy dissipation device as claimed in claim 2, wherein said secondary core module includes a first section and a second section, said resilient compression unit including a resilient module that is disposed between said first section and said second section of said secondary core module.

4. The energy dissipation device as claimed in claim 2, wherein said resilient compression unit includes a support member and a resilient member, said first preload tension member extending through one of said first inner plate and said second inner plate, extending through said resilient member, and being positioned relative to said support member, said resilient member being sandwiched between said support member and the one of said first inner plate and said second inner plate through which said first preload tension member extends.

5. The energy dissipation device as claimed in claim 2, wherein said resilient compression unit includes a support member and a resilient member, said second preload tension member extending through one of said first outer plate and said second outer plate, extending through said resilient member, and being positioned relative to said support member, said resilient member being sandwiched between said support member and the one of said first outer plate and said second outer plate through which said second preload tension member extends.

6. The energy dissipation device as claimed in claim 1, wherein said first inner plate and said second inner plate are located between said first outer plate and said second outer plate, said opposite end portion of said first preload tension member being connected to said second outer plate, said opposite end portion of said second preload tension member being connected to said second inner plate.

7. The energy dissipation device as claimed in claim 6, wherein said resilient compression unit includes a first resilient member, a second resilient member, a first support member and a second support member, said first preload tension member extending through said second outer plate, extending through said second resilient member, and being positioned relative to said second support member, said second resilient member being sandwiched between said second support member and said second outer plate, said second preload tension member extending through said first outer plate, extending through said first resilient member, and being positioned relative to said first support member, said first resilient member being sandwiched between said first support member and said first outer plate.

8. The energy dissipation device as claimed in claim 6, wherein said secondary core module includes a first section and a second section, said resilient compression unit including a resilient module that is disposed between said first section and said second section of said secondary core module.

9. The energy dissipation device as claimed in claim 6, wherein said first push portion and said second push portion of said outer tubular body of said housing module are respectively in indirect contact with said first outer plate and said second outer plate, and are located between said first outer plate and said second outer plate, said resilient compression unit including a first resilient member and a second resilient member, said opposite end portion of said first preload tension member extending through said second push portion of said outer tubular body, extending through said second resilient member, and being positioned relative to said second outer plate, said second resilient member being sandwiched between said second push portion of said outer tubular body and said second outer plate, said end portion of said second preload tension member extending through said first push portion of said outer tubular body, extending through said first resilient member, and being positioned relative to said first outer plate, said first resilient member being sandwiched between said first outer plate and said first push portion of said outer tubular body.

10. The energy dissipation device as claimed in claim 6, wherein said second push portion of said outer tubular body of said housing module is disposed adjacent to said second outer plate, and is located between said first outer plate and said second outer plate, said primary core module further including a primary support member that is connected to said primary extension section of said primary core module, said resilient compression unit including a first resilient member and a second resilient member, said opposite end portion of said first preload tension member extending through said second push portion of said outer tubular body, extending through said second resilient member, and being positioned relative to said second outer plate, said second resilient member being sandwiched between said second push portion of said outer tubular body and said second outer plate, said end portion of said second preload tension member extending through said first outer plate, extending through said first resilient member, and being positioned relative to said primary support member, said first resilient member being sandwiched between said first outer plate and said primary support member.

11. The energy dissipation device as claimed in claim 6, wherein said said first push portion and said second push portion of said main body of said primary core module are respectively in indirect contact with said first outer plate and said second outer plate, and are located between said first outer plate and said second outer plate, said resilient compression unit including a first resilient member and a second resilient member, said opposite end portion of said first preload tension member extending through said second push portion of said main body of said primary core module, extending through said second resilient member, and being positioned relative to said second outer plate, said second resilient member being sandwiched between said second push portion of said main body of said primary core module and said second outer plate, said end portion of said second preload tension member extending through said first push portion of said main body of said primary core module, extending through said first resilient member, and being positioned relative to said first outer plate, said first resilient member being sandwiched between said first outer plate and said first push portion of said main body of said primary core module.

* * * * *